US007588313B2

(12) United States Patent
Kawaguchi et al.

(10) Patent No.: US 7,588,313 B2
(45) Date of Patent: Sep. 15, 2009

(54) PRINTER HAVING FLUSHING CONTROL UNIT TO EXECUTE FLUSHING PRINTING ON THE PRINT MEDIUM

(75) Inventors: Yasuhiko Kawaguchi, Nagoya (JP); Motoshi Kishi, Nagoya (JP); Haruna Kato, Tsushima (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 183 days.

(21) Appl. No.: 11/532,047

(22) Filed: Sep. 14, 2006

(65) Prior Publication Data

US 2007/0057983 A1 Mar. 15, 2007

(30) Foreign Application Priority Data

Sep. 14, 2005 (JP) ..... 2005-266771

(51) Int. Cl.
*B41J 2/165* (2006.01)
*B41J 23/00* (2006.01)

(52) U.S. Cl. ..... 347/35; 347/23; 347/37

(58) Field of Classification Search ..... 347/35
See application file for complete search history.

(56) References Cited

U.S. PATENT DOCUMENTS

| | | | | |
|---|---|---|---|---|
| 5,659,342 | A * | 8/1997 | Lund et al. | 347/35 |
| 5,903,288 | A * | 5/1999 | Yamaguchi | 347/35 |
| 6,109,721 | A * | 8/2000 | Kim | 347/19 |
| 6,145,981 | A * | 11/2000 | Akahira et al. | 347/19 |
| 6,166,828 | A * | 12/2000 | Yamada et al. | 347/35 |
| 6,290,325 | B2 * | 9/2001 | Minowa et al. | 347/35 |
| 6,505,906 | B1 * | 1/2003 | Bland et al. | 347/35 |
| 6,619,783 | B2 | 9/2003 | Kanaya et al. | |
| 6,619,784 | B2 * | 9/2003 | Bauer | 347/23 |
| 6,932,456 | B2 | 8/2005 | Kanaya et al. | |
| 2005/0275683 | A1 * | 12/2005 | Furuichi et al. | 347/35 |
| 2005/0275687 | A1 * | 12/2005 | Furuichi et al. | 347/43 |
| 2006/0214979 | A1 * | 9/2006 | Inoue | 347/22 |

FOREIGN PATENT DOCUMENTS

| | | | |
|---|---|---|---|
| JP | 1980139269 | A | 10/1980 |
| JP | 1993084887 | A | 4/1993 |
| JP | 1995314708 | A | 12/1995 |
| JP | 2001026123 | A | 1/2001 |
| JP | 2001180007 | A | 7/2001 |
| JP | 2002234188 | A | 8/2002 |
| JP | 2005088196 | A | 4/2005 |
| WO | 03031186 | A1 | 4/2003 |

* cited by examiner

*Primary Examiner*—Matthew Luu
*Assistant Examiner*—Shelby Fidler
(74) *Attorney, Agent, or Firm*—Baker Botts L.L.P.

(57) ABSTRACT

A printer comprises: an inkjet head including nozzles for discharging ink; a holding member which holds a print medium; a moving mechanism which moves the holding member and/or the inkjet head so as to move the inkjet head relative to the holding member in a main scanning direction and a sub scanning direction for printing by the inkjet head on the print medium; and a print control unit which controls the inkjet head and the moving mechanism so as to execute flushing printing on the print medium for preventing clogging of the nozzles while moving the inkjet head relative to the holding member in a first printing direction in the main scanning direction and to execute pattern printing on the print medium according to pattern printing data while moving the inkjet head relative to the holding member in a second printing direction in the main scanning direction.

3 Claims, 20 Drawing Sheets

PRINTER HAVING FLUSHING CONTROL UNIT TO EXECUTE FLUSHING PRINTING ON THE PRINT MEDIUM

CROSS-REFERENCE TO RELATED APPLICATION

This application claims priority under 35 U.S.C. §119 from Japanese Patent Application No. 2005-266771, filed on Sep. 14, 2005. The entire subject matter of the application is incorporated herein by reference.

BACKGROUND

1. Technical Field

The present disclosure relates to a printer, and in particular, to a printer comprising a holding member which holds a print medium to be printed on and an inkjet head which executes printing on the print medium held by the holding member by discharging ink.

2. Related Art

An inkjet printer on the market today generally comprises a color inkjet head including a number of inkjet nozzles. Such an inkjet printer is designed to execute color printing by discharging inks of multiple colors from the inkjet nozzles onto a print medium (paper, etc.) of a desired size according to printing data while moving the inkjet head to and fro in a main scanning direction (parallel to the direction of printing) and by successively shifting the inkjet head in a sub scanning direction orthogonal to the main scanning direction (line feed).

For example, in an inkjet printer described in Japanese Patent Provisional Publication No. 2002-234188 (page 4, FIG. 1) (hereinafter referred to as a "document #1"), a carriage on which an inkjet head is mounted to face downward is configured to be movable in the horizontal direction and a desired image is formed on paper being fed by a feeding roller by discharging ink downward from the inkjet head onto the paper.

The inkjet printer of the document #1 further comprises an ink receiving member (for receiving ink discharged from the inkjet head for the flushing of the inkjet head) which is placed to face the inkjet head at the far right of a platen. Therefore, when the flushing is executed at the start of printing or in the middle of printing, the inkjet head has to be withdrawn to a maintenance position facing the ink receiving member.

Meanwhile, a variety of printing techniques have been proposed for printing patterns, designs, etc. on various types of fabrics, and there have also been proposed inkjet printers capable of printing patterns, designs, etc. on a surface of fabric by discharging color inks from the inkjet nozzles onto the fabric according to printing data while moving the inkjet head relative to the fabric in an X direction and a Y direction orthogonal to each other.

For example, in a printer described in Japanese Patent Provisional Publication No. HEI05-84887 (pages 2-3, FIG. 2, FIG. 3) (hereinafter referred to as a "document #2"), a Y-movement bar is held to be movable in a Y direction along grooves formed on both lateral faces of a machine frame which is formed in a U-shape in the plan view, an X-movement arm is supported to be movable along the Y-movement bar, an inkjet head is attached to the end of the X-movement arm, and a fabric holding frame holding fabric to be printed on is mounted and fixed on a table placed at the center of the machine frame. In the printer, the inkjet head executes printing on the fixed fabric by discharging ink according to printing data while moving in the X and Y directions.

However, the aforementioned printers involve the following problems. The size of the inkjet printer of the document #1 is necessitated to be large especially in the printing direction since the ink receiving member (for receiving ink discharged for the flushing of the inkjet head) has to be placed at a particular flushing position (outside a printing range) at the far right of the platen.

Also when such an ink receiving member is installed in the printer of the document #2, the ink receiving member has to be placed outside the fabric holding frame in order to prevent the fabric (held by the fabric holding frame) from being smeared with ink. With the long moving distance of the inkjet head in the printing direction, the enlargement of the printer is inevitable.

While the printer of the document #2 is designed to execute printing on the fixed fabric by moving the inkjet head in the X and Y directions orthogonal to each other, such a printer may also be configured to execute the printing by moving the fabric holding frame (holding the fabric) in the X and Y directions relative to an inkjet head placed at a fixed position. In this case, the flushing can be carried out by moving the inkjet head (which is fixed during the printing) from a printing position (close to the fabric) to a maintenance position (above the printing position) and thereafter moving a maintenance mechanism including the ink receiving member in a horizontal direction to let the ink receiving member face the inkjet head at the maintenance position.

However, such a flushing operation requires the elevation of the inkjet head and the horizontal movement of the maintenance mechanism to be performed in cooperation with each other. Therefore, the flushing operation takes a long maintenance time and that delays the printing process.

SUMMARY

Aspects of the present disclosure are advantageous in that a printer capable of executing the flushing of the inkjet head without the need of the ink receiving member can be provided while realizing a reduced maintenance time for the flushing, speeding up of the printing process, and miniaturization of the printer.

BRIEF DESCRIPTION OF THE ACCOMPANYING DRAWINGS

DETAILED DESCRIPTION

General Overview

Figure 1:
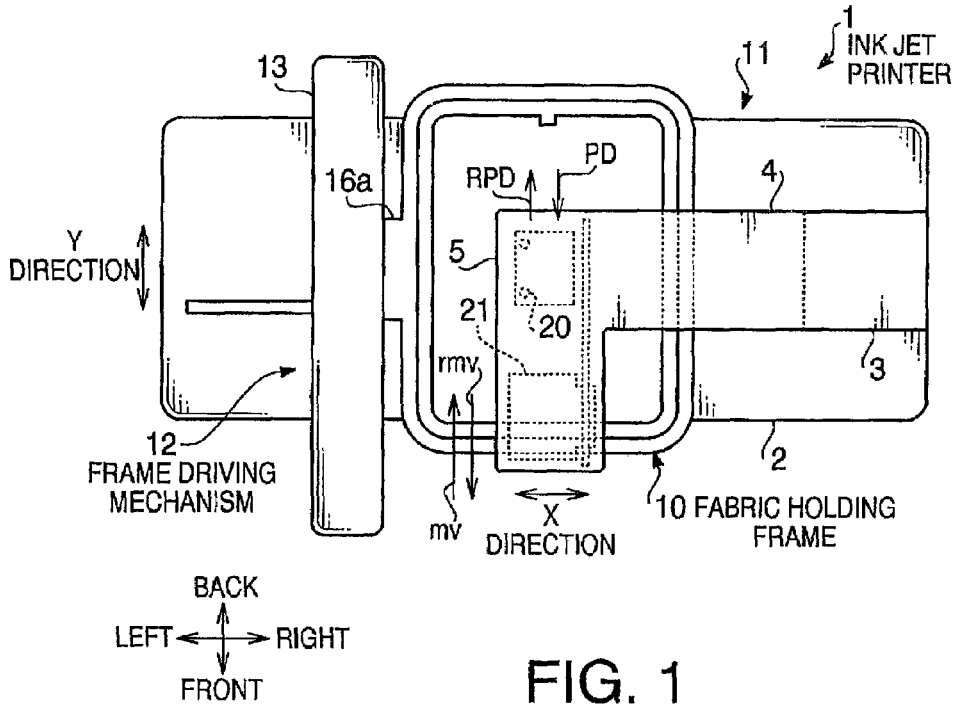
FIG. 1 is a plan view of a printer in accordance with an embodiment of the present disclosure.

It is noted that various connections are set forth between elements in the following description. It is noted that these connections in general and unless specified otherwise, may be direct or indirect and that this specification is not intended to be limiting in this respect. Aspects of the invention may be implemented in computer software as programs storable on computer-readable media including but not limited to RAMs, ROMs, flash memory, EEPROMs, CD-media, DVD-media, temporary storage, hard disk drives, floppy drives, permanent storage, and the like.

In accordance with an aspect of the present disclosure, there is provided a printer comprising: an inkjet head including a plurality of nozzles for discharging ink; a holding member which holds a print medium to be printed on; a moving mechanism which moves at least one of the holding member and the inkjet head so as to move the inkjet head relative to the holding member in a main scanning direction and a sub scanning direction for printing by the inkjet head on the print medium; and a print control unit which controls the inkjet head and the moving mechanism so as to execute flushing printing on the print medium for preventing clogging of the nozzles while moving the inkjet head relative to the holding member in a first printing direction in the main scanning direction and to execute pattern printing on the print medium according to pattern printing data while moving the inkjet head relative to the holding member in a second printing direction in the main scanning direction.

Under the control of the print control unit, the flushing printing on the print medium is executed when the inkjet head is moved relative to the holding member in the first printing direction in the main scanning direction (first half of to-and-fro movement of the inkjet head relative to the holding member), and the pattern printing on the print medium is executed when the inkjet head is moved relative to the holding member in the second printing direction in the main scanning direction (second half of the to-and-fro movement). In other words, the flushing printing is executed first and thereafter the pattern printing is executed over the result of the flushing printing. Therefore, the flushing of the inkjet head can be carried out without fail before the pattern printing while preventing ill effect of the flushing printing on the pattern printed by the pattern printing.

In the above configuration, the flushing of the inkjet head (which is generally executed separately from the printing process) is incorporated in the pattern printing, by which the maintenance time necessary for the flushing can be reduced and the printing process can be speeded up while executing the flushing process without fail.

Further, the ink receiving member (which is generally necessary for the flushing) is left out in the above configuration, by which cost reduction and miniaturization of the printer become possible. Since the result of the flushing printing is concealed later by the pattern printing (in a part covered by the pattern printing), the pattern itself (printed by the pattern printing) is prevented from being affected by the flushing printing. It is also possible to use the result of the flushing printing as a background pattern since part of the result of the flushing printing that is not covered by the pattern printing remains visible, by which decorative effect of the pattern printed by the pattern printing can be enhanced.

In at least one aspect, the print control unit executes the print control so that the flushing printing is executed in a low dot density throughout a pattern printing area for the pattern printing according to the pattern printing data.

In the above configuration, the print control unit executes the print control so that the flushing printing is executed in a low dot density throughout the pattern printing area (area for the pattern printing according to the pattern printing data), by which the result of the flushing printing can be prevented from standing out from the pattern printed by the pattern printing even when the pattern includes a pale-colored part.

In at least one aspect, the printer further comprises a flushing printing data storage unit which stores multiple types of flushing printing data for the flushing printing. The print control unit includes a selection unit which lets a user select a desired type of flushing printing data from the multiple types of flushing printing data stored in the flushing printing data storage unit.

In the above configuration, the user is allowed to select desired flushing printing data from the multiple types of flushing printing data stored in the flushing printing data storage unit and the flushing printing is executed according to the selected flushing printing data, by which decorative effect of the flushing printing (flushing printing pattern) can be enhanced.

Preferably, the print medium is fabric and the holding member is a fabric holding frame which holds the fabric.

In the above configuration, the pattern printing can be executed also to fabric held by the fabric holding frame while carrying out the flushing of the inkjet head without fail.

In at least one aspect, the inkjet head is placed at a fixed position for the printing, and the moving mechanism moves the holding member relative to the fixed inkjet head in the main scanning direction and the sub scanning direction for the printing.

In the above configuration, the miniaturization of the printer and the reduction of the maintenance time necessary for the flushing can be achieved remarkably.

In accordance with another aspect of the present disclosure, there is provided a printer comprising: an inkjet head including a plurality of nozzles for discharging ink; a holding member which holds a print medium to be printed on; a moving mechanism which moves at least one of the holding member and the inkjet head so as to move the inkjet head relative to the holding member in a main scanning direction and a sub scanning direction for printing by the inkjet head on the print medium; a flushing area setting unit which sets a flushing printing area in a frame shape or ring shape, for flushing printing executed for preventing clogging of the nozzles, inside or outside a pattern printing area of the print medium for pattern printing; and a print control unit which controls the inkjet head and the moving mechanism so as to execute the pattern printing in the pattern printing area and the flushing printing in the flushing printing area while moving the inkjet head relative to the holding member to and fro in the main scanning direction.

In a stage before the printing process, the flushing printing area in a frame shape or ring shape (for the flushing printing) is set inside or outside the pattern printing area by the flushing area setting unit. In the printing process, the pattern printing is executed in the pattern printing area and the flushing printing is executed in the flushing printing area while the inkjet head is moved relative to the holding member to and fro in the main scanning direction. Since the flushing printing is executed in the flushing printing area (in a frame shape or ring shape) which is separate from the pattern printed by the pattern printing, the flushing of the inkjet head can be carried out without fail while preventing ill effect of the flushing printing on the pattern printed by the pattern printing.

In the above configuration, the flushing of the inkjet head (which is generally executed separately from the printing process) is incorporated in the pattern printing, by which the maintenance time necessary for the flushing can be reduced and the printing process can be speeded up while executing the flushing process without fail.

Further, the ink receiving member (which is generally necessary for the flushing) is left out in the above configuration, by which cost reduction and miniaturization of the printer become possible. Since the flushing printing is executed in the flushing printing area (in a frame shape or ring shape) which is separate from the pattern printed by the pattern printing, ill effect of the flushing printing on the pattern printed by the pattern printing can be prevented. Furthermore, the result of the pattern printing can be used as an ornamental frame since the result of the pattern printing is visible inside or outside the pattern printing area, by which decorative effect of the whole pattern can be enhanced.

In at least one aspect, the printer further comprises a flushing printing data storage unit which stores multiple types of flushing printing data for the flushing printing. The print control unit includes a selection unit which lets a user select a desired type of flushing printing data from the multiple types of flushing printing data stored in the flushing printing data storage unit.

In the above configuration, the user is allowed to select desired flushing printing data from the multiple types of flushing printing data stored in the flushing printing data storage unit and the flushing printing is executed according to the selected flushing printing data, by which decorative effect of the flushing printing (flushing printing pattern) can be enhanced.

In at least one aspect, the print medium is fabric and the holding member is a fabric holding frame which holds the fabric.

In the above configuration, the pattern printing can be executed also to fabric held by the fabric holding frame while carrying out the flushing of the inkjet head without fail.

In at least one aspect, the inkjet head is placed at a fixed position for the printing, and the moving mechanism moves the holding member relative to the fixed inkjet head in the main scanning direction and the sub scanning direction for the printing.

In the above configuration, the miniaturization of the printer and the reduction of the maintenance time necessary for the flushing can be achieved remarkably.

In accordance with another aspect of the present disclosure, there is provided a printer comprising: an inkjet head including a plurality of nozzles for discharging ink; a holding member which holds a print medium to be printed on; a moving mechanism which moves at least one of the holding member and the inkjet head so as to move the inkjet head relative to the holding member in a main scanning direction and a sub scanning direction for printing by the inkjet head on the print medium; and a print control unit which controls the inkjet head and the moving mechanism so as to execute flushing printing for preventing clogging of the nozzles in an acceleration section and a deceleration section regarding the movement of the inkjet head relative to the holding member in the main scanning direction by the moving mechanism.

Under the control of the print control unit, the flushing printing on the print medium is executed in the acceleration section and the deceleration section (regarding the movement of the inkjet head relative to the holding member in the main scanning direction). Since the flushing printing is executed in the acceleration and deceleration sections which are separate from a pattern printing area (area for pattern printing), the flushing of the inkjet head can be carried out without fail before and after the pattern printing while preventing ill effect of the flushing printing on the pattern printed by the pattern printing.

In the above configuration, the flushing of the inkjet head (which is generally executed separately from the printing process) is incorporated in the pattern printing, by which the maintenance time necessary for the flushing can be reduced and the printing process can be speeded up while executing the flushing process without fail.

Further, the ink receiving member (which is generally necessary for the flushing) is left out in the above configuration, by which cost reduction and miniaturization of the printer become possible. Since the flushing printing is executed in the acceleration and deceleration sections which are separate from the pattern printing area, ill effect of the flushing printing on the pattern printed by the pattern printing can be prevented. Furthermore, the result of the pattern printing can be used as an ornamental frame since the result of the pattern printing is visible in the acceleration and deceleration sections separate from the pattern printing area, by which decorative effect of the whole pattern can be enhanced.

In at least one aspect, the printer further comprises a flushing printing data storage unit which stores multiple types of flushing printing data, in which ink discharging timing is set so as to avoid ill effect of the acceleration and deceleration of the inkjet head relative to the holding member, for the flushing printing. The print control unit includes a selection unit which lets a user select a desired type of flushing printing data from the multiple types of flushing printing data stored in the flushing printing data storage unit.

In the above configuration, the user is allowed to select desired flushing printing data from the multiple types of flushing printing data stored in the flushing printing data storage unit and the flushing printing is executed according to the selected flushing printing data, by which decorative effect of the flushing printing (flushing printing pattern) can be enhanced. Further, the flushing printing pattern can be printed on the print medium evenly as a natural pattern without distortion since the ink discharging timing is set in the flushing printing data so as to avoid ill effect of the acceleration and deceleration of the inkjet head relative to the holding member.

In at least one aspect, the print medium is fabric and the holding member is a fabric holding frame which holds the fabric.

In the above configuration, the pattern printing can be executed also to fabric held by the fabric holding frame while carrying out the flushing of the inkjet head without fail.

In at least one aspect, the inkjet head is placed at a fixed position for the printing, and the moving mechanism moves the holding member relative to the fixed inkjet head in the main scanning direction and the sub scanning direction for the printing.

In the above configuration, the miniaturization of the printer and the reduction of the maintenance time necessary for the flushing can be achieved remarkably.

Embodiment

Referring now to the drawings, a description will be given in detail of a preferred embodiment in accordance with the present disclosure.

In a printer described in the following embodiment, "flushing printing" for the flushing of the inkjet head is executed in parallel with "pattern printing" (printing of a pattern, design, etc. on fabric attached to a fabric holding frame), without providing the printer with the ink receiving member (for receiving ink discharged from the inkjet head for the flushing).

Figure 2:
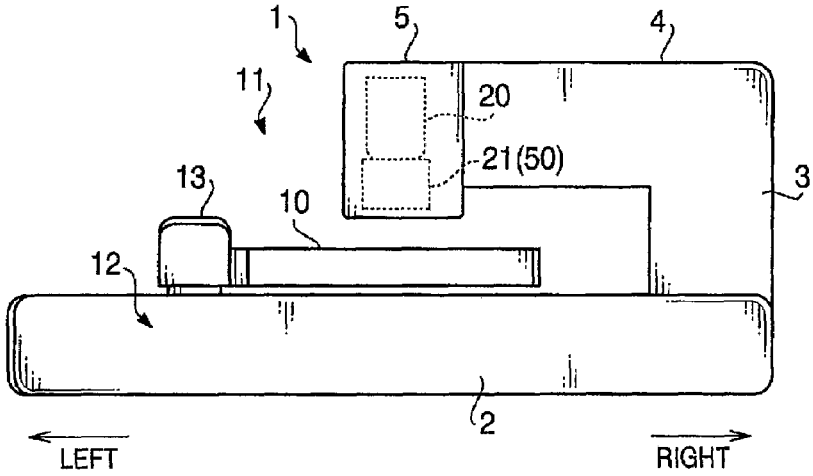
FIG. 2 is a front view of the printer.

FIG. 1 is a plan view of a printer 1 in accordance with an embodiment of the present disclosure. FIG. 2 is a front view of the printer 1. The printer 1 shown in FIGS. 1 and 2 is an inkjet printer which prints a desired pattern, design, etc. (hereinafter also referred to simply as a "pattern") on fabric W held by a fabric holding frame 10 (including an inner frame 15 and an outer frame 16) by discharging color ink from an inkjet head 36 (hereinafter simply referred to as a "print head 36") of a printing unit 30.

As shown in FIGS. 1 and 2, the printer 1 is mainly composed of a main unit 11 and a frame driving mechanism 12. The main unit 11 includes a printing mechanism 20 and a maintenance mechanism 21. The printing mechanism 20 includes the fabric holding frame 10 for holding fabric W detachably and the print head 36 for executing inkjet printing on the fabric W held by the fabric holding frame 10. The maintenance mechanism 21 maintains the print head 36 of the printing mechanism 20 in fine condition suitable for printing. The frame driving mechanism 12 drives the fabric holding frame 10 in an X direction and a Y direction (orthogonal to each other) independently in order to move the printing position of the print head 36 on the fabric W in the two orthogonal directions (X and Y directions) independently.

Figure 3:
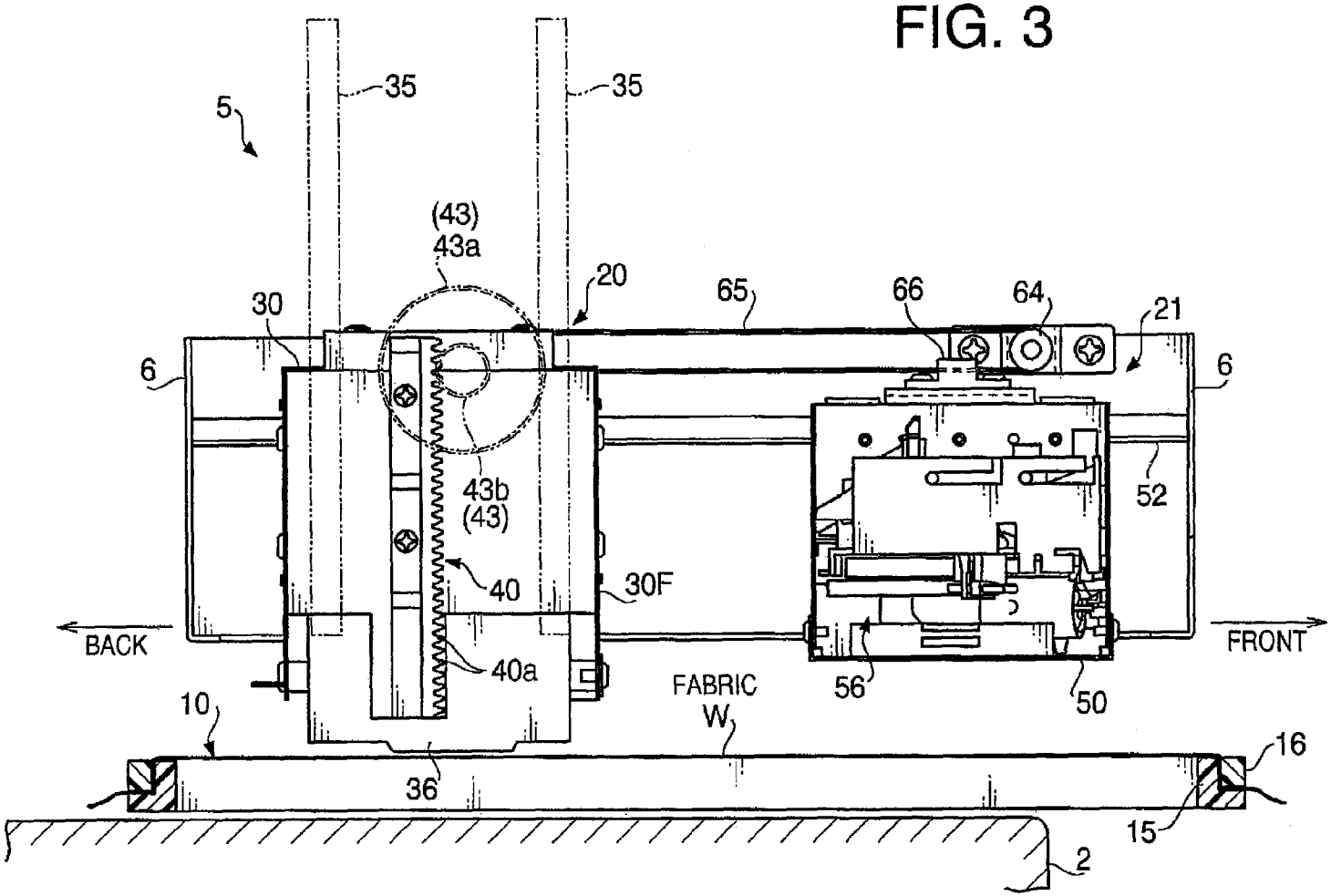
FIG. 3 is a left side view of a main unit of the printer.
Figure 6:
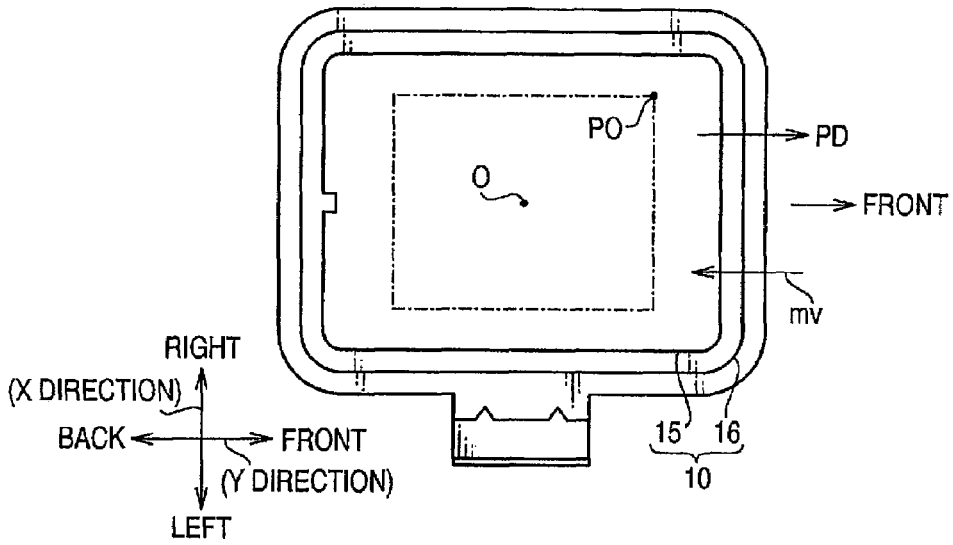
FIG. 6 is a plan view showing a fabric holding frame of the printer.

FIG. 3 is a left side view of the main unit 11 of the printer 1. FIG. 6 is a plan view showing the fabric holding frame 10. As shown in FIGS. 1, 3 and 6, the fabric holding frame 10 includes the inner frame 15 and the outer frame 16 which are made of synthetic resin. Before the printing is executed, the fabric W to be printed on is sandwiched and held between the inner frame 15 and the outer frame 16 as shown in FIG. 3. Since an adhesive lining (unshown) has previously been stuck on the back (underside) of the fabric W, the fabric W is set and held in the fabric holding frame 10 in a flat and strained state.

As shown in FIG. 1, the outer frame 16 has a connecting part 16*a* formed integrally therewith. The connecting part 16*a* of the outer frame 16 is detachably attached to a Y carriage 13 of the frame driving mechanism 12. Incidentally, while the fabric holding frame 10 in this embodiment is in a rectangular shape, the fabric holding frame 10 may of course be formed in various shapes (elliptical shape, circular shape, etc.).

As shown in FIGS. 1 and 2, the main unit 11 includes a bed part 2 extending horizontally, a post part 3 standing on the extreme right of the bed part 2, and an arm part 4 extending leftward from the post part 3. The frame driving mechanism 12 is installed in the bed part 2. The arm part 4 is formed in an L-shape in the plan view (FIG. 1) to protrude forward, and the protruding part (extending forward) is formed as a mechanism installation part 5. The printing mechanism 20 and the maintenance mechanism 21 are installed in the mechanism installation part 5.

The printing mechanism 20 is installed in a rear part of the mechanism installation part 5 to be movable upward and downward. Meanwhile, the maintenance mechanism 21 is installed to be movable forward and backward between a standby position (at the front end of the mechanism installation part 5) and a maintenance position (at the rear end of the mechanism installation part 5 and under the printing mechanism 20). In FIGS. 1 and 6, the direction of backward movement of the fabric holding frame 10 (holding the fabric W) is indicated by an arrow "mv", while the printing direction of the print head 36 of the printing mechanism 20 (on the fabric W) in this case is indicated by an arrow "PD". On the other hand, the direction of forward movement of the fabric holding frame 10 (opposite to the arrow "mv") is indicated by an arrow "rmv", while the printing direction of the print head 36 of the printing mechanism 20 in this case is indicated by an arrow "RPD".

While the fabric holding frame 10 is movable both in the Y direction (forward/backward) and in the X direction (rightward/leftward) as shown in FIG. 1 by the driving force of the frame driving mechanism 12, the printing on the fabric W by the print head 36 (printing mechanism 20) is executed when the fabric holding frame 10 is moved in the Y direction (i.e. main scanning direction).

After the printing of a line (a print cycle) is finished, the fabric holding frame 10 is shifted rightward or leftward (in the X direction (i.e. sub scanning direction)) and thereafter the printing of the next line is executed. As above, the printing on the fabric W is carried out throughout the whole printable range (printable area) of the fabric holding frame 10 by repeating the movement of the fabric holding frame 10 in the moving directions mv and rmv (i.e. the movement of the print head 36 relative to the fabric holding frame 10 in the printing directions PD and RPD (main scanning direction)) and the shifting of the fabric holding frame 10 in the X direction (sub scanning direction).

Figure 7:
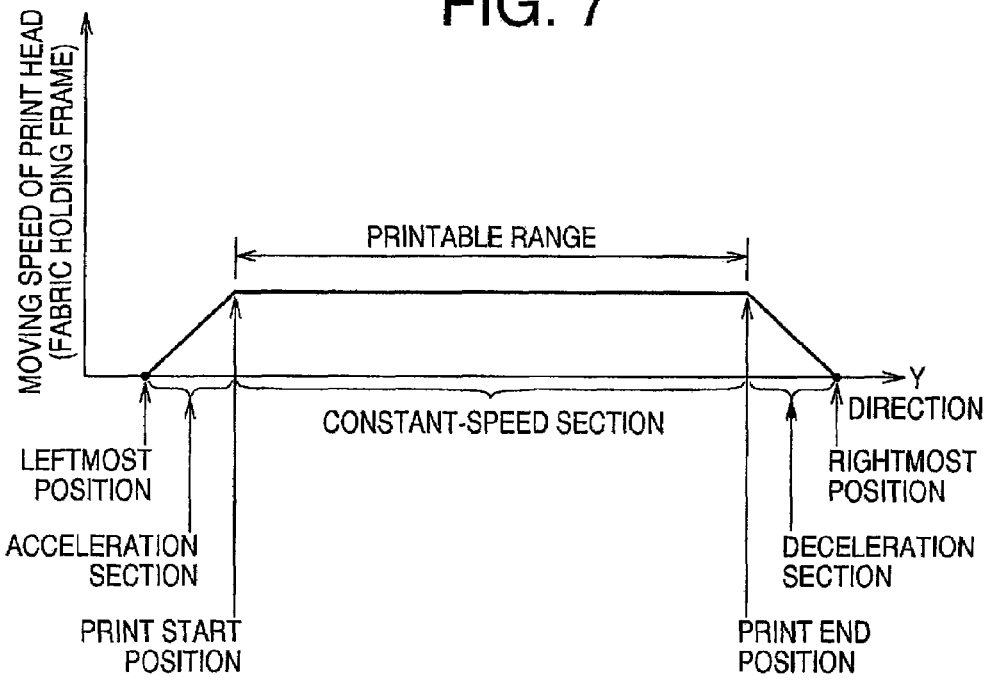
FIG. 7 is a graph showing a pattern of movement of a print head relative to a fabric holding frame.
Figure 24:
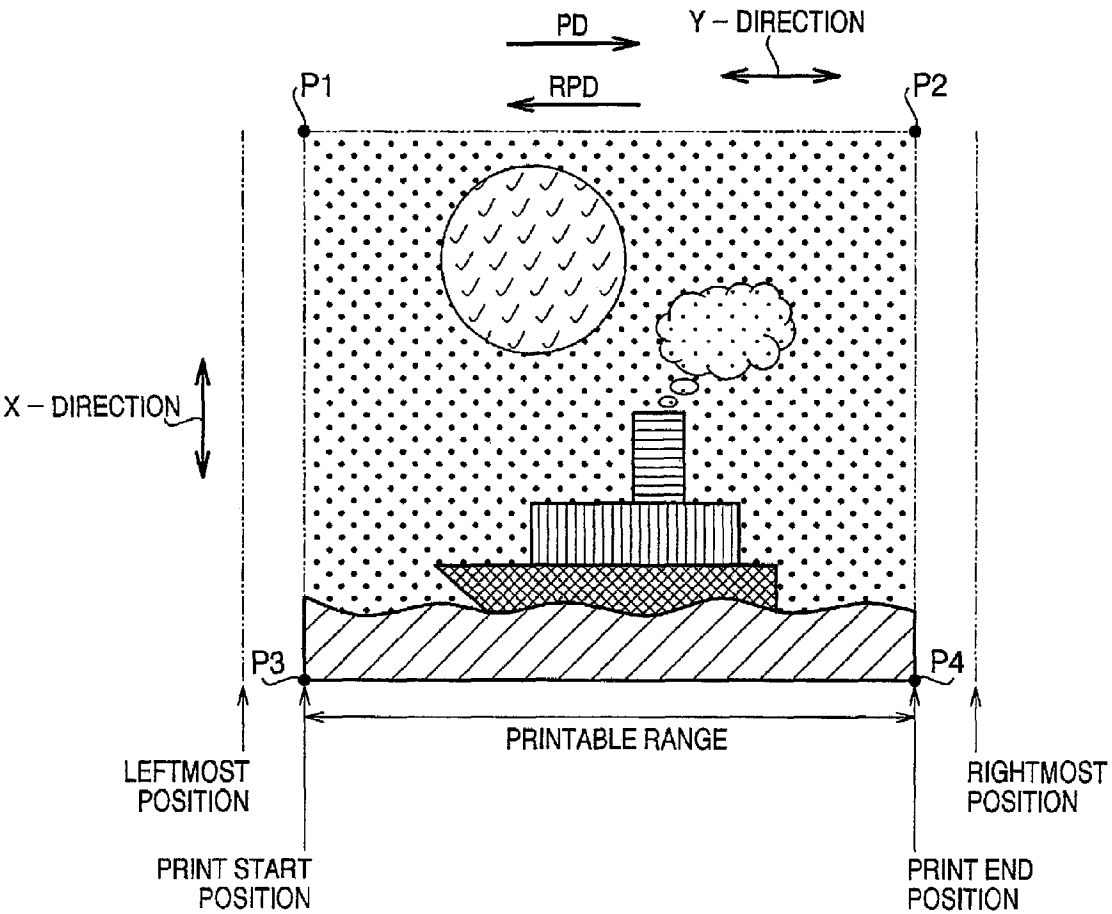
FIG. 24 is a schematic diagram showing an example of the result of the flushing/pattern printing process according to the flushing mode FM1.

In the printing process, when the print head 36 is moved (relative to the fabric W) in the printing direction PD as shown in FIGS. 6 and 24 (by actually moving the fabric holding frame 10 in the moving direction mv), the movement of the print head 36 relative to the fabric W (i.e. the actual movement of the fabric holding frame 10) is controlled as shown in FIG. 7. Specifically, the print head 36 (relative to the fabric W) accelerates to a prescribed speed in an acceleration section between a leftmost position (to the left of the printable range in FIG. 7) and a print start position, moves at the prescribed speed in a constant-speed section between the print start position and a print end position, and decelerates in a deceleration section between the print end position and a rightmost position (to the right of the printable range in FIG. 7). When the print head 36 is moved (relative to the fabric W) in the printing direction RPD opposite to the printing direction PD (by actually moving the fabric holding frame 10 in the moving direction rmv opposite to the moving direction mv), the acceleration section and the deceleration section interchange with each other.

Although not shown in the figures, the front face of the post part 3 is provided with a display (for displaying a pattern, design, etc. to be printed on the fabric W and various setting screens), a touch panel (for letting the user make selections), various switches, various indicator lamps (for indicating setting statuses), etc. The front face of the post part 3 is further provided with jacks for connection of the printer 1 with electronic devices (e.g. personal computer) via USB cables, etc. and connectors to which memory cards (ROM card, RAM card, etc.) can be attached.

The frame driving mechanism 12 includes a Y direction driving unit (unshown) for driving the fabric holding frame 10 (attached to the Y carriage 13 provided on the bed part 2) in the Y direction (forward/backward) with its Y direction driving motor 87 (see FIG. 8), an X direction driving unit (unshown) embedded in the bed part 2 for driving the Y carriage 13 in the X direction (rightward/leftward) with its X direction driving motor 85 (see FIG. 8), a carriage position sensor 94 (see FIG. 8) for detecting the X direction position and Y direction position of the Y carriage 13 (corresponding to the X direction position and Y direction position of the fabric holding frame 10), a drive circuit 86 (see FIG. 8) for driving the X direction driving motor 85, a drive circuit 88 (see FIG. 8) for driving the Y direction driving motor 87, etc.

Figure 4:
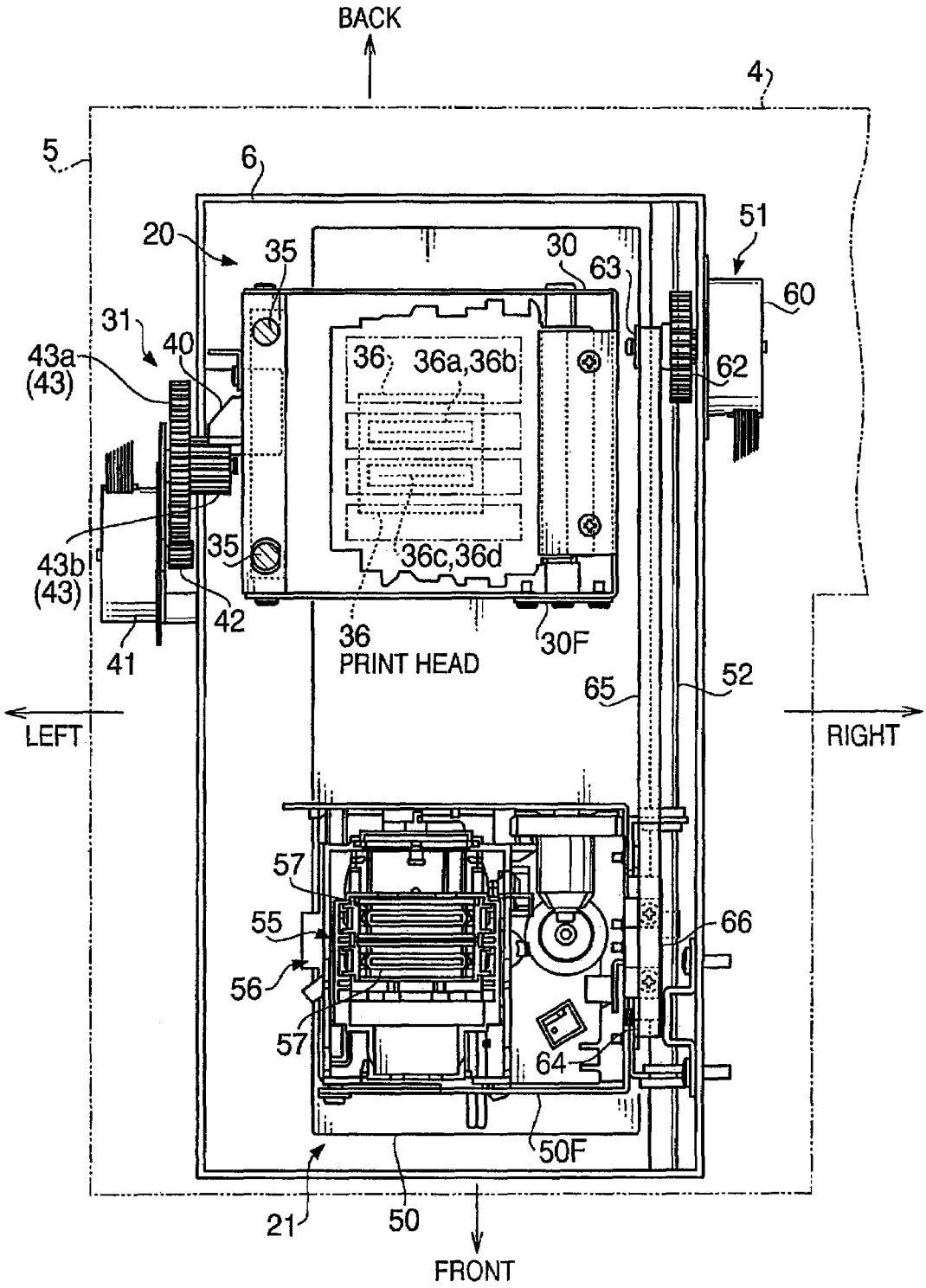
FIG. 4 is a plan view of the main unit.
Figure 5:
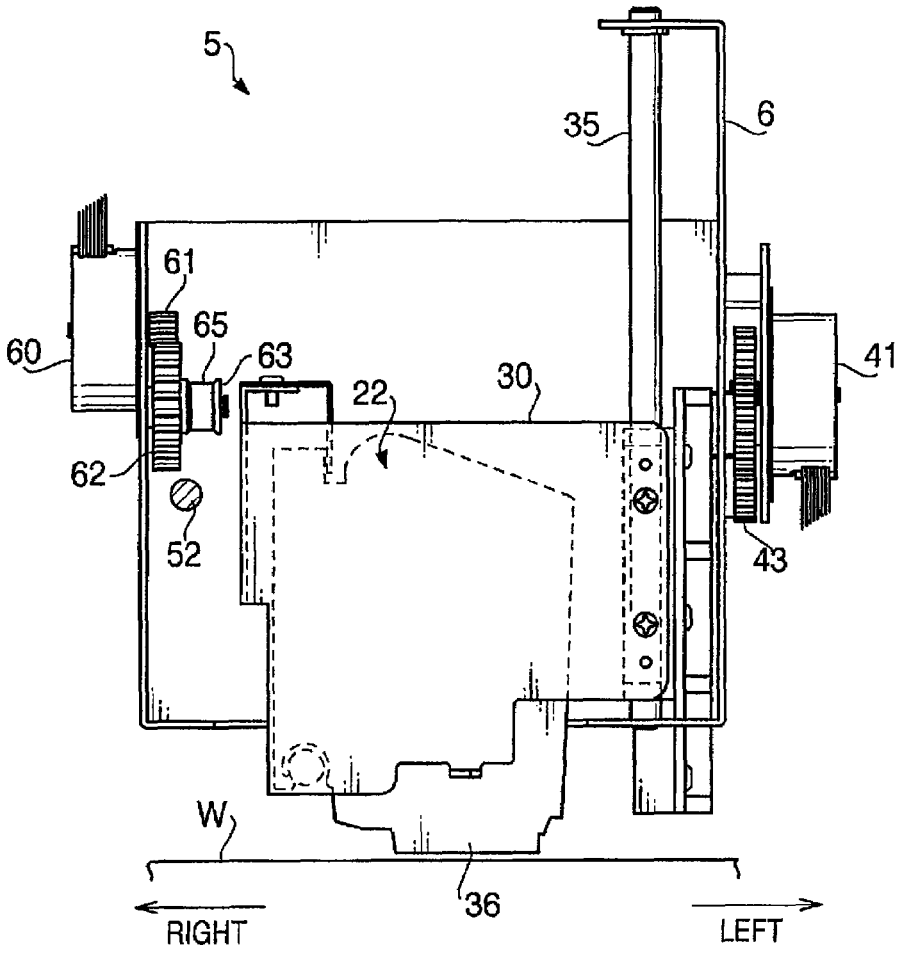
FIG. 5 is a rear view of the main unit.

Next, the printing mechanism 20 installed in the mechanism installation part 5 will be explained in detail referring to FIGS. 3-5. FIG. 3 is a left side view of the main unit 11 of the printer 1 as mentioned above. FIG. 4 is a plan view of the main unit 11. FIG. 5 is a rear view of the main unit 11. The mechanism installation part 5 includes a chassis 6 like a rectangular frame. The printing mechanism 20 is placed in the back of the chassis 6. As shown in FIG. 4, the printing mechanism 20 includes the printing unit 30 (having the print head 36) and a vertical driving unit 31 for driving the printing unit 30 vertically (moving the printing unit 30 toward and away from the fabric W).

First, the printing unit 30 formed in a box shape will be explained. As shown in FIG. 4, in a rear left part of the chassis 6, a pair of head guide shafts 35 extending vertically are placed front and back with their upper and lower ends supported by the chassis 6. A unit frame 30F of the printing unit 30 is supported by the pair of head guide shafts 35 at its left end to be movable vertically. The printing unit 30 is implemented by an inkjet printing unit.

Thus, in the printing unit 30, the print head 36 (inkjet head) is placed at the bottom to face downward, and although not shown in the figures, four ink cartridges for storing inks of four colors (cyan, magenta, yellow and black) and ink supply tubes for connecting the ink cartridges with the print head 36 are accommodated above the print head 36.

As shown in FIG. 4, the print head 36 includes four nozzle arrays 36*a*-36*d* for the four colors, in which two adjacent nozzle arrays 36*a* and 36*b* are placed close to each other and integrated as a rear nozzle unit and remaining two adjacent nozzle arrays 36*c* and 36*d* are also placed close to each other and integrated as a front nozzle unit. Each nozzle array 36*a*-36*d* includes a number of (e.g. 64) nozzles arranged in a zigzag pattern, by which a print width of approximately 1 inch is covered. According to print instructions from a control unit 70 which will be explained later, piezoelectric ceramic actuators in the print head 36 are selectively bent and the inks of the four colors supplied from the ink cartridges are selectively discharged from the four nozzle arrays 36*a*-36*d* toward the fabric W placed under the print head 36 in a manner of "one dot-line printing".

Here, the "one dot-line printing" will be explained briefly. In the case where the printing is executed using each nozzle array 36*a*-36*d* for each color, at each discharging timing (discharging time: row 1, row 2, row 3, . . . arranged in a row direction (Y direction) in FIG. 9, for example), the printing (selective discharging of ink according to printing data) is executed at once by the nozzles n1, n2, n3, . . . arranged in two lines, by which the printing of one dot line ("one dot-line printing") is completed. The "one dot-line printing" is executed successively at each discharging timing (row 1, row 2, row 3, . . . ) according to the printing data.

In this case, on each completion of a one dot-line printing by the print head 36 progressing in the printing direction PD, the fabric holding frame 10 is moved in the moving direction mv by a short distance corresponding to one dot. On the other hand, on each completion of a one dot-line printing by the print head 36 progressing in the printing direction RPD, the fabric holding frame 10 is moved in the moving direction rmv by a short distance corresponding to one dot.

Next, the vertical driving unit 31 for driving the printing unit 30 vertically will be explained. As shown in FIGS. 3-5, a rack member 40 extending vertically is fixed on the left side face of the unit frame 30F of the printing unit 30 by use of a plurality of screws. Meanwhile, on a part of the chassis 6 corresponding to the left side face of the unit frame 30F, a head vertical driving motor 41 is fixed and a composite gear 43 having a large-diameter gear 43*a* (for engaging with a drive gear 42 fixed on the drive shaft of the head vertical driving motor 41) is supported to be rotatable. A small-diameter gear 43*b* of the composite gear 43 engages with cogs 40*a* of the rack member 40 of the printing unit 30.

Thus, when the head vertical driving motor 41 rotates clockwise/counterclockwise, the printing unit 30 (being guided by the pair of head guide shafts 35 and receiving the driving force of the head vertical driving motor 41 via the drive gear 42, the composite gear 43 and the rack member 40) is moved upward/downward between a printing position (at the lower end) shown in FIG. 3 and an upper position.

Next, the maintenance mechanism 21 for executing a purge process (not during printing), etc. will be explained in detail. As shown in FIGS. 3 and 4, the maintenance mechanism 21 includes a maintenance unit 50 (having a capping mechanism 55, a purge mechanism 56, etc.) which is movable forward and backward inside the chassis 6 and a forward/backward driving mechanism 51 for driving the maintenance unit 50 forward and backward.

First, the maintenance unit 50 in a box shape will be explained. As shown in FIG. 4, a maintenance guide shaft 52 extending in the Y direction (forward/backward) is placed in the rightmost part of the chassis 6 with its front and rear ends fixed to the chassis 6. A unit frame 50F of the maintenance unit 50 is supported by the maintenance guide shaft 52 at its right end to be movable in the Y direction (forward/backward). Meanwhile, an engaging member fixed to the maintenance unit 50 is engaged with the lower end of the chassis 6, by which the maintenance unit 50 is support by the chassis 6 to be movable (slidable) in the Y direction (forward/backward) by the driving force of the forward/backward driving mechanism 51 (explained later).

The maintenance unit 50 includes the capping mechanism 55, the purge mechanism 56, etc., by which a cap process and the purge process are made possible.

The capping mechanism 55 will be explained briefly. The capping mechanism 55 has a pair of head caps 57 made of rubber, designed to be able to closely contact (cap) the head surface of the print head 36 (which has been moved upward to the upper position when no printing is executed) from below in the vicinity of the top of the unit frame 50F of the maintenance unit 50. When no printing is executed by the printer 1, a purge motor 80 (see FIG. 8) of the purge mechanism 56 (explained below) drives the head caps 57 upward to let the head caps 57 contact and cover (cap) the head surface from below, by which a number of ink nozzles of the print head 36 is prevented from drying.

The purge mechanism 56 will be explained briefly. The purge mechanism 56 includes the pair of head caps 57, a suction pump 82 (see FIG. 8), etc. When the head caps 57 have risen to the capping position as explained above, the suction pump 82 is activated to cause negative pressure inside the head caps 57 capping the head surface, by which bubbles (clogging up the ink nozzles) and high-viscosity ink remaining in the ink nozzles of the print head 36 are sucked out and fine printing condition is maintained (purge process).

Next, the forward/backward driving mechanism 51 for driving the maintenance unit 50 forward and backward will be explained. As shown in FIGS. 4 and 5, a forward/backward driving motor 60 is mounted on a rear end part of the right side face of the chassis 6. A drive gear 61 is fixed on the drive shaft of the forward/backward driving motor 60, and a large-diameter driven gear 62 engaging with the drive gear 61 is rotatably supported by the chassis 6. The driven gear 62 is formed integrally with a drive pulley 63. As shown in FIGS. 3 and 4, a driven pulley 64 is rotatably supported by a front part of the right side face of the chassis 6. A drive belt 65 as a timing belt is stretched across the drive pulley 63 and the driven pulley 64.

An upper part of the unit frame 50F of the maintenance unit 50 is fixed to a part of the drive belt 65 by use of fixing hardware 66. Therefore, by activating the forward/backward driving motor 60, the maintenance unit 50 (driven by the forward/backward driving motor 60 via the drive gear 61, the driven gear 62, the drive pulley 63 and the drive belt 65) can be moved forward and backward between the standby position (front position shown in FIGS. 3 and 4) and the maintenance position (rear position, unshown).

Figure 8:
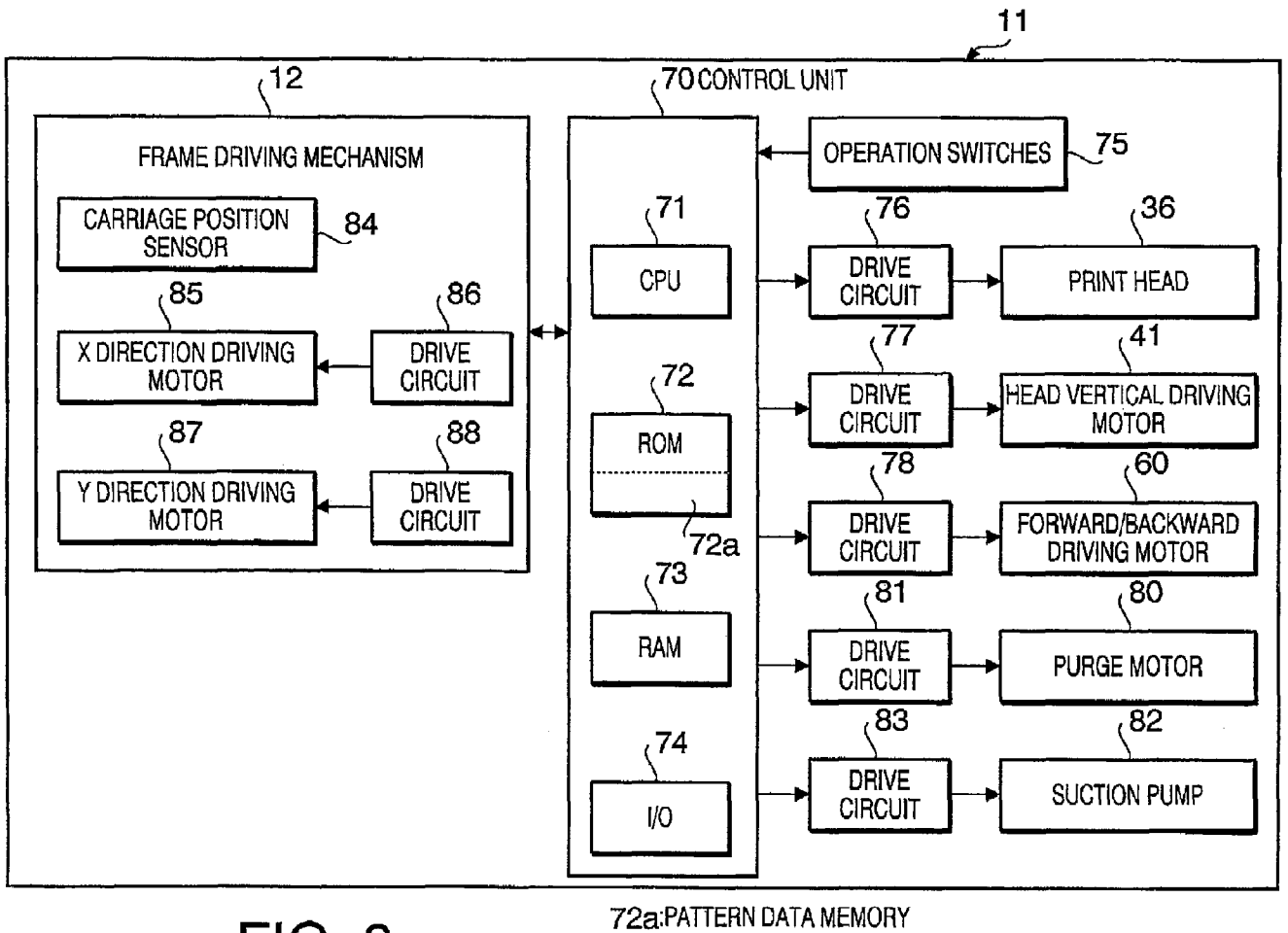
FIG. 8 is a block diagram of a control system of the printer.

Next, a control system of the printer 1 will be explained referring to a block diagram of FIG. 8.

The main unit 11 of the printer 1 includes the control unit 70 (having a CPU 71, a ROM 72, a RAM 73 and an input-output interface (I/O) 74), various operation switches 75 (such as a print start switch and a frame movement switch connected to the control unit 70), a drive circuit 76 for driving the print head 36, a drive circuit 77 for driving the head vertical driving motor 41, a drive circuit 78 for driving the forward/backward driving motor 60, a drive circuit 81 for driving the purge motor 80, a drive circuit 83 for driving the suction pump 82, etc.

Drive control programs for controlling the driving of the frame driving mechanism 12, the printing mechanism 20, the maintenance unit 50, the forward/backward driving mechanism 51, the capping mechanism 55 and the purge mechanism 56 are prestored in the ROM 72 of the control unit 70. Various types (e.g. 15 types) of flushing printing pattern data (see FIGS. 9-16) are prestored in a pattern data memory 72*a* of the ROM 72. It is also possible to load various types of flushing printing pattern data from a personal computer or an external memory (e.g. memory card) into the RAM 73 via the I/O 74.

The various types of flushing printing pattern data are usable in common for the four nozzle arrays 36*a*-36*d* for the four colors. Incidentally, each piece of flushing printing pattern data (each flushing printing pattern) has been designed so that flushing printing of low dot density can be executed, that is, so that the result of the flushing printing will not stand out from that of the pattern printing.

Figure 9:
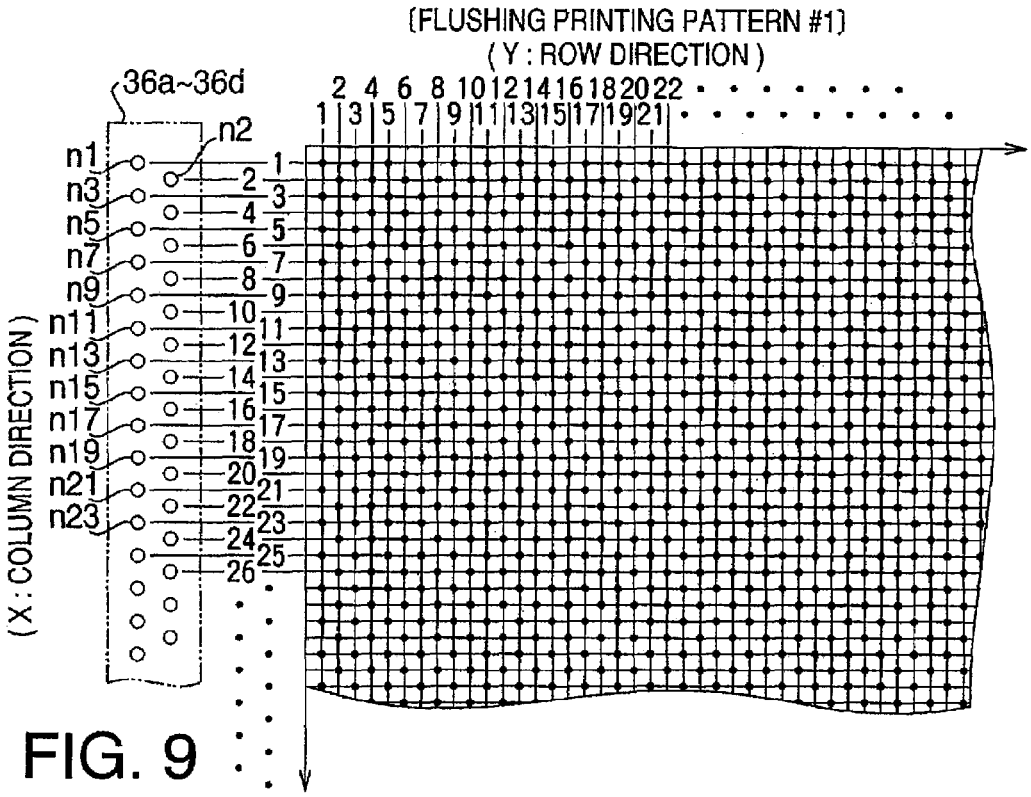
FIG. 9 is a schematic diagram for explaining a flushing printing pattern #1 employed by the printer.

For example, for a "flushing printing pattern #1" shown in FIG. 9, data representing the timing (in the Y direction or row direction) of activation of each of the nozzles n1-n64 has been stored as an operational expression. Specifically, an operational expression specifying activation of (ink discharging from) odd-numbered nozzles n1, n3, n5, . . . in odd rows "1, 3, 5, . . . " and activation of (ink discharging from) even-numbered nozzles n2, n4, n6, . . . in even rows "2, 4, 6, . . . " has been stored in the pattern data memory 72*a*.

Figure 10:
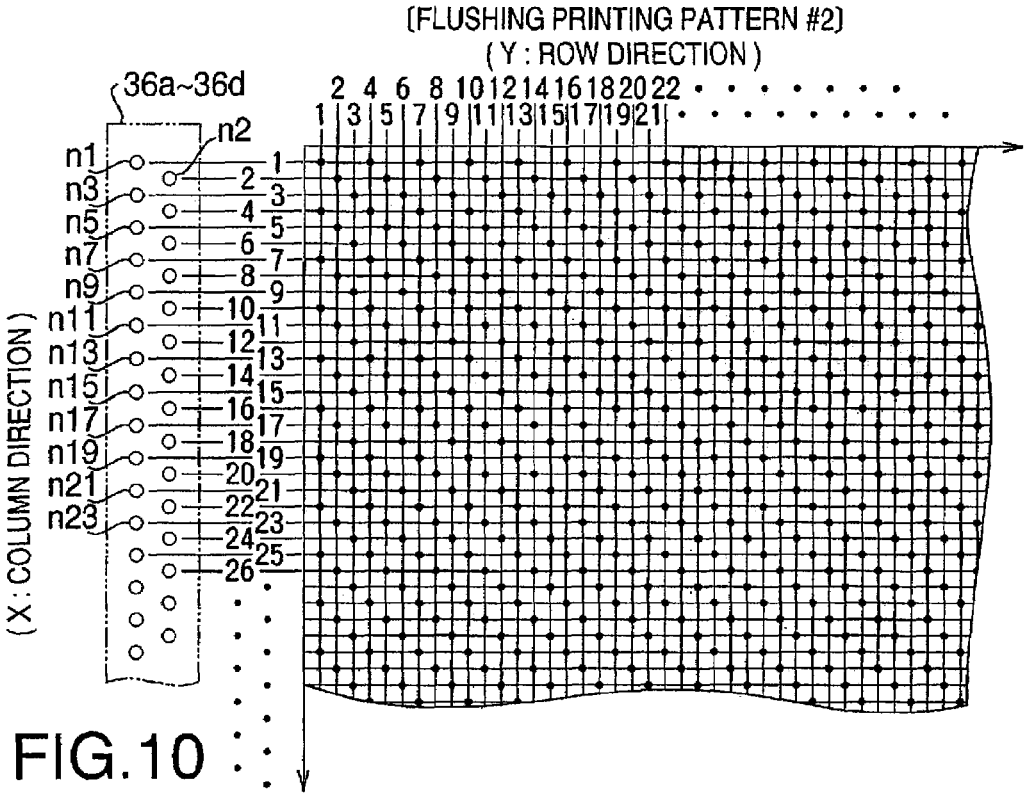
FIG. 10 is a schematic diagram for explaining a flushing printing pattern #2 employed by the printer.

For a "flushing printing pattern #2" shown in FIG. 10, an operational expression specifying activation of (ink discharging from) nozzles n(1+3a) (a: 0, 1, 2, . . . ) in rows "1+3b" (b: 0, 1, 2, . . . ), activation of nozzles n(2+3a) (a: 0, 1, 2, . . . ) in rows "2+3b" (b: 0, 1, 2, . . . ) and activation of nozzles n(3+3a) (a: 0, 1, 2, . . . ) in rows "3+3b" (b: 0, 1, 2, . . . ) has been stored in the pattern data memory 72*a*.

Figure 11:
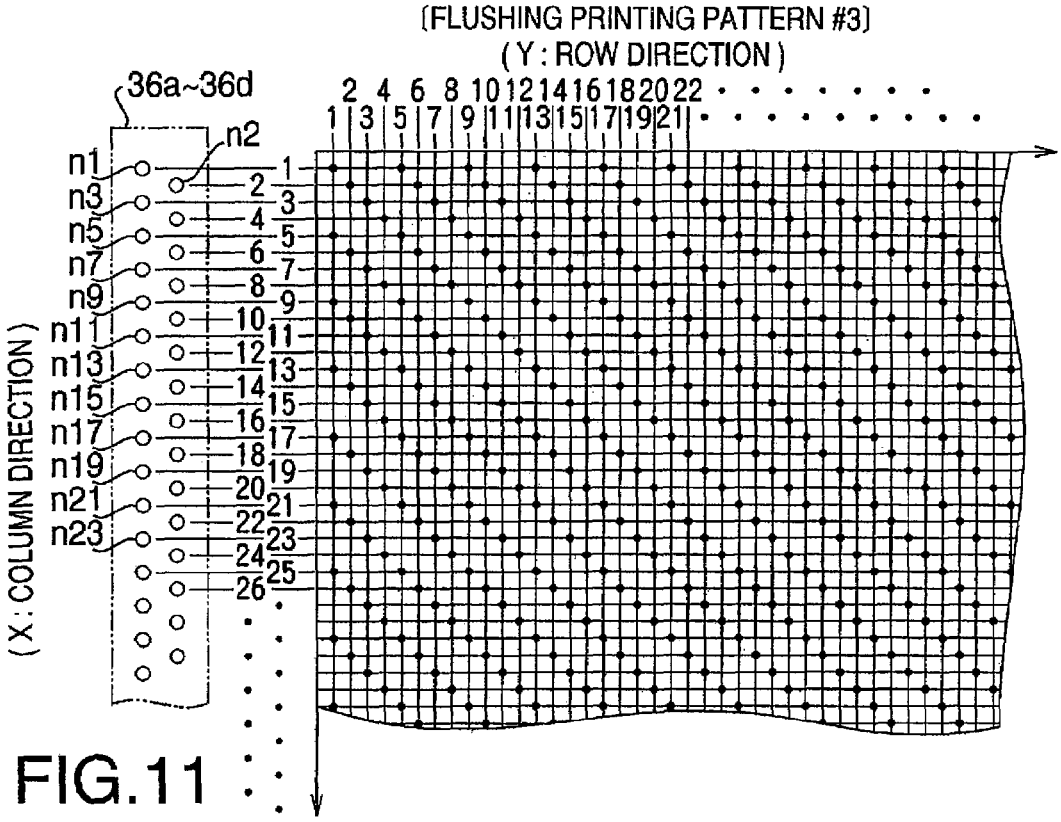
FIG. 11 is a schematic diagram for explaining a flushing printing pattern #3 employed by the printer.

For a "flushing printing pattern #3" shown in FIG. 11, an operational expression specifying activation of (ink discharging from) nozzles n(1+4a) (a: 0, 1, 2, . . . ) in rows "1+4b" (b: 0, 1, 2, . . . ), activation of nozzles n(2+4a) (a: 0, 1, 2, . . . ) in rows "2+4b" (b: 0, 1, 2, . . . ), activation of nozzles n(3+4a) (a: 0, 1, 2, . . . ) in rows "3+4b" (b: 0, 1, 2, . . . ) and activation of nozzles n(4+4a) (a: 0, 1, 2, . . . ) in rows "4+4b" (b: 0, 1, 2, . . . ) has been stored in the pattern data memory 72*a*.

Figure 12:
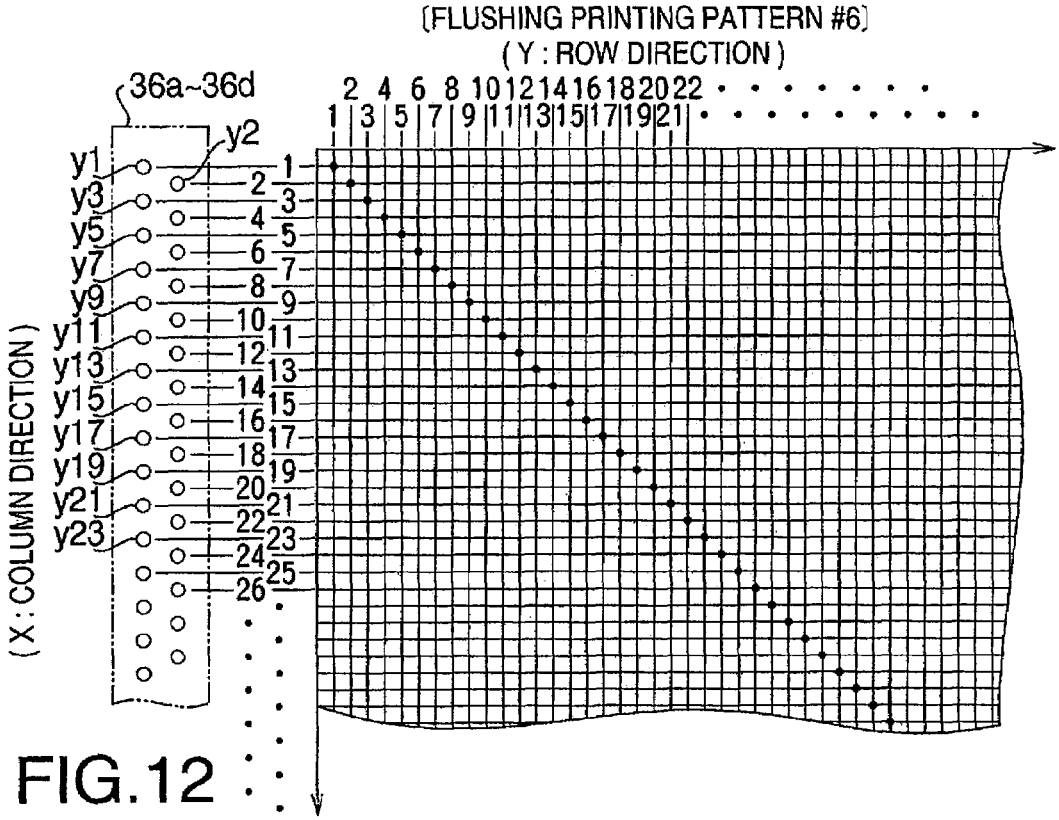
FIG. 12 is a schematic diagram for explaining a flushing printing pattern #6 employed by the printer.

For a "flushing printing pattern #6" shown in FIG. 12, an operational expression specifying activation of (ink discharging from) each nozzle n(a) in a row "a" (a: 1, 2, . . . ) has been stored in the pattern data memory 72*a*.

Figure 13:
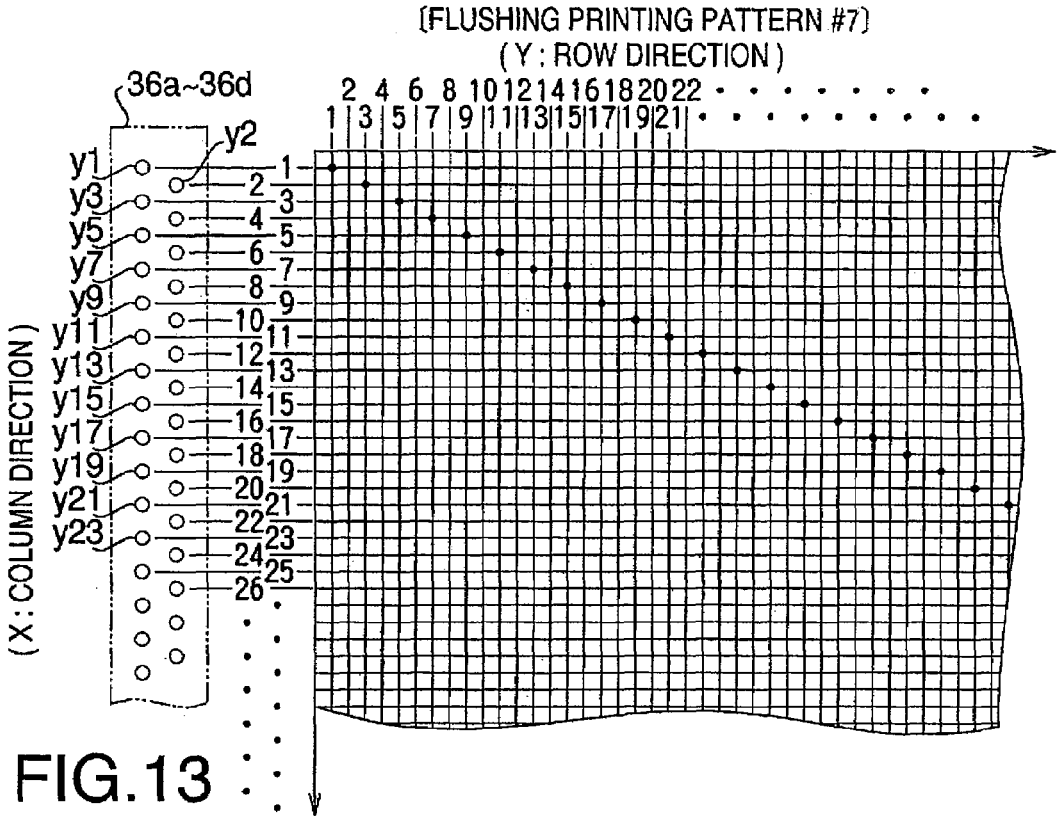
FIG. 13 is a schematic diagram for explaining a flushing printing pattern #7 employed by the printer.

For a "flushing printing pattern #7" shown in FIG. 13, an operational expression specifying activation of (ink discharging from) each nozzle n(a) in a row "2a−1" (a: 1, 2, . . . ) has been stored in the pattern data memory 72*a*.

Figure 14:
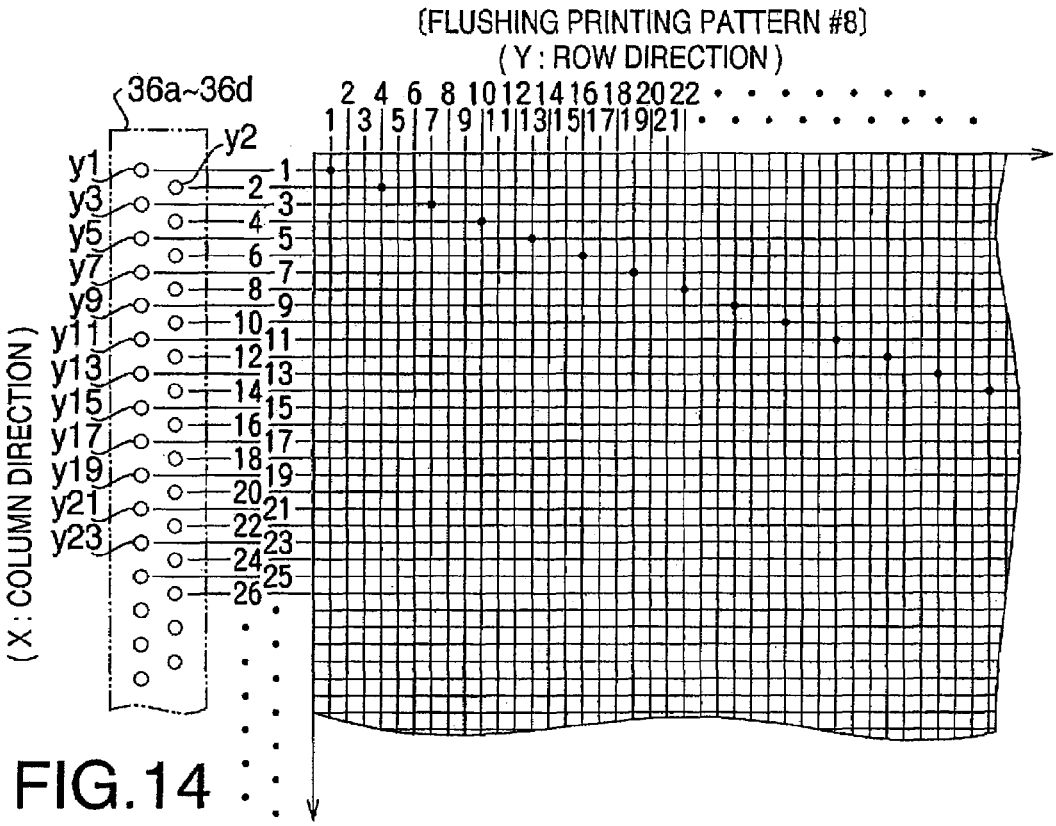
FIG. 14 is a schematic diagram for explaining a flushing printing pattern #8 employed by the printer.

For a "flushing printing pattern #8" shown in FIG. 14, an operational expression specifying activation of (ink discharging from) each nozzle n(a) in a row "3a−2" (a: 1, 2, . . . ) has been stored in the pattern data memory 72*a*.

Figure 15:
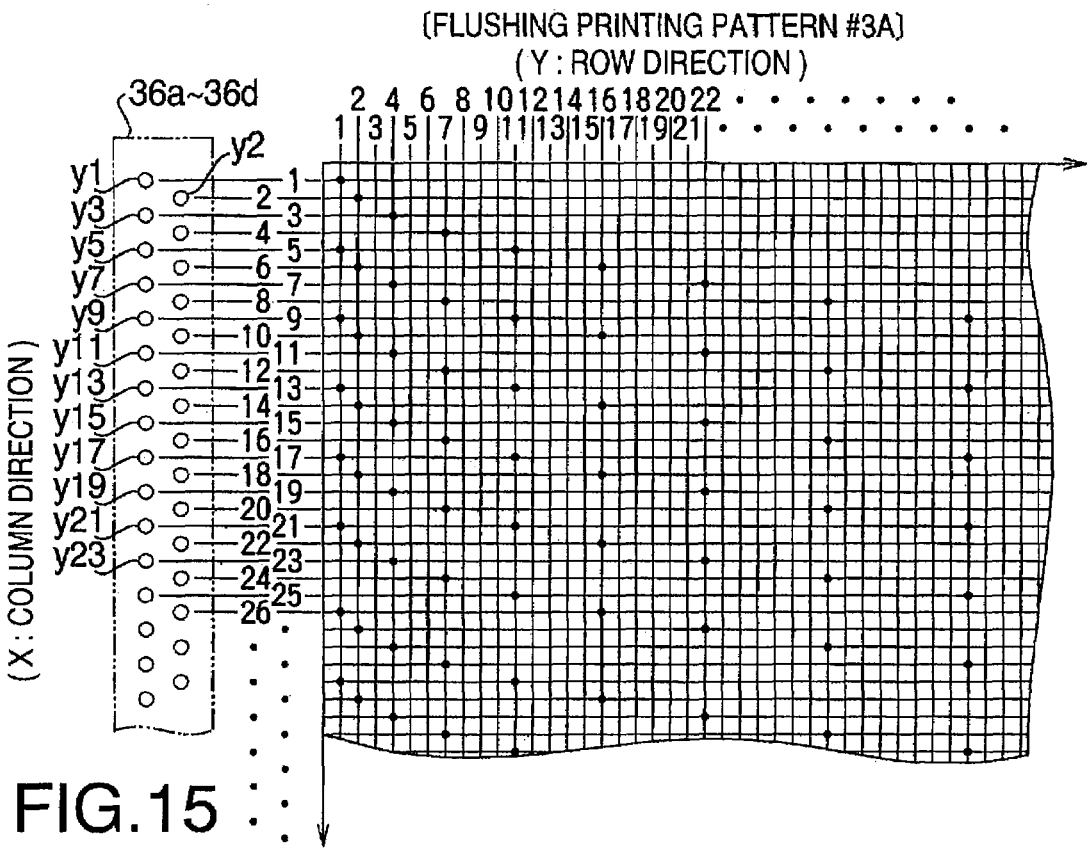
FIG. 15 is a schematic diagram for explaining a flushing printing pattern #3A employed by the printer.

A "flushing printing pattern #3A" shown in FIG. 15 is a pattern to be used in the acceleration section (before the constant-speed section). For the flushing printing pattern #3A, flushing printing pattern data, designed so that ink discharging timing of the nozzles n will become faster according to the change of speed of the fabric holding frame 10 in the acceleration section shown in FIG. 7, has been stored in the pattern data memory 72*a*. With the flushing printing pattern data, the flushing printing in the acceleration section can be executed without being affected by the acceleration of the fabric holding frame 10, that is, a natural pattern can be printed in the flushing printing evenly with no distortion.

Figure 16:
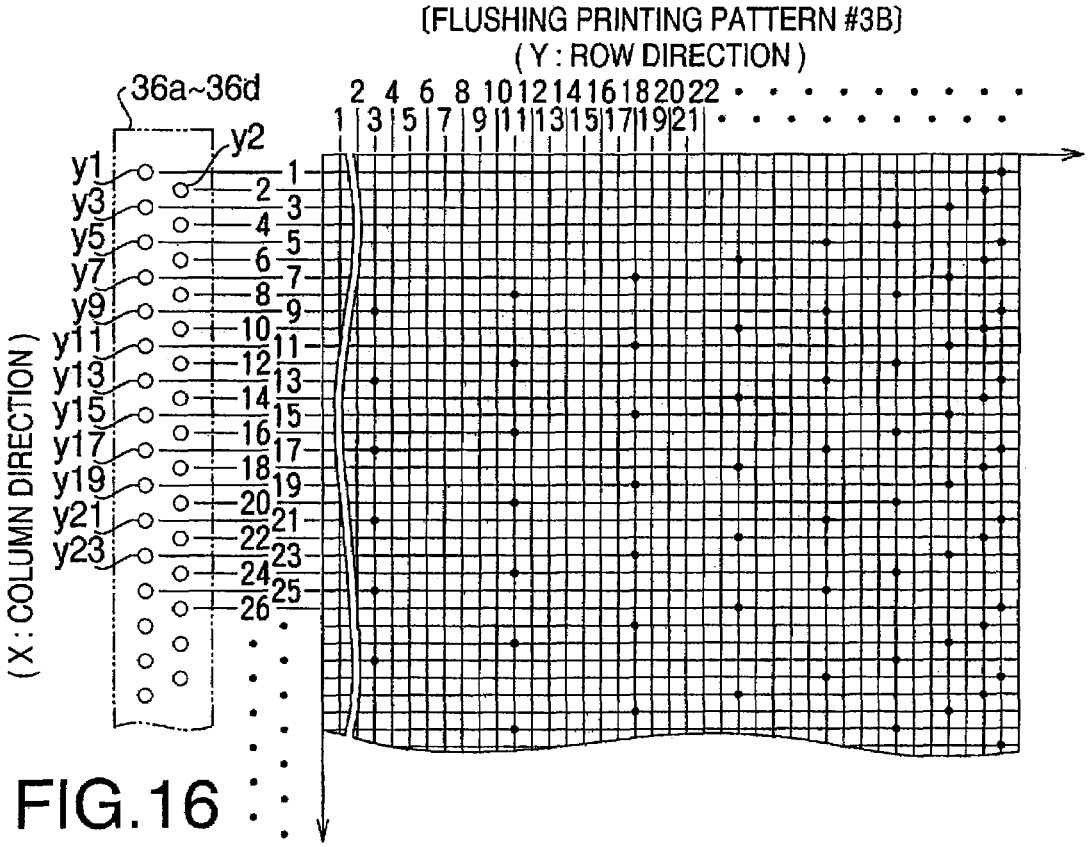
FIG. 16 is a schematic diagram for explaining a flushing printing pattern #3B employed by the printer.

A "flushing printing pattern #3B" shown in FIG. 16 is a pattern to be used in the deceleration section (after the constant-speed section). For the flushing printing pattern #3B, flushing printing pattern data, designed so that ink discharging timing of the nozzles n will become slower according to the change of speed of the fabric holding frame 10 in the deceleration section shown in FIG. 7, has been stored in the pattern data memory 72*a*. With the flushing printing pattern data, the flushing printing in the deceleration section can be executed without being affected by the deceleration of the fabric holding frame 10, that is, a natural pattern can be printed in the flushing printing evenly with no distortion.

In the following, a print control process executed by the control unit 70 of the main unit 11 of the printer 1 will be described in detail referring to flow charts of FIGS. 17-23.

Figure 17:
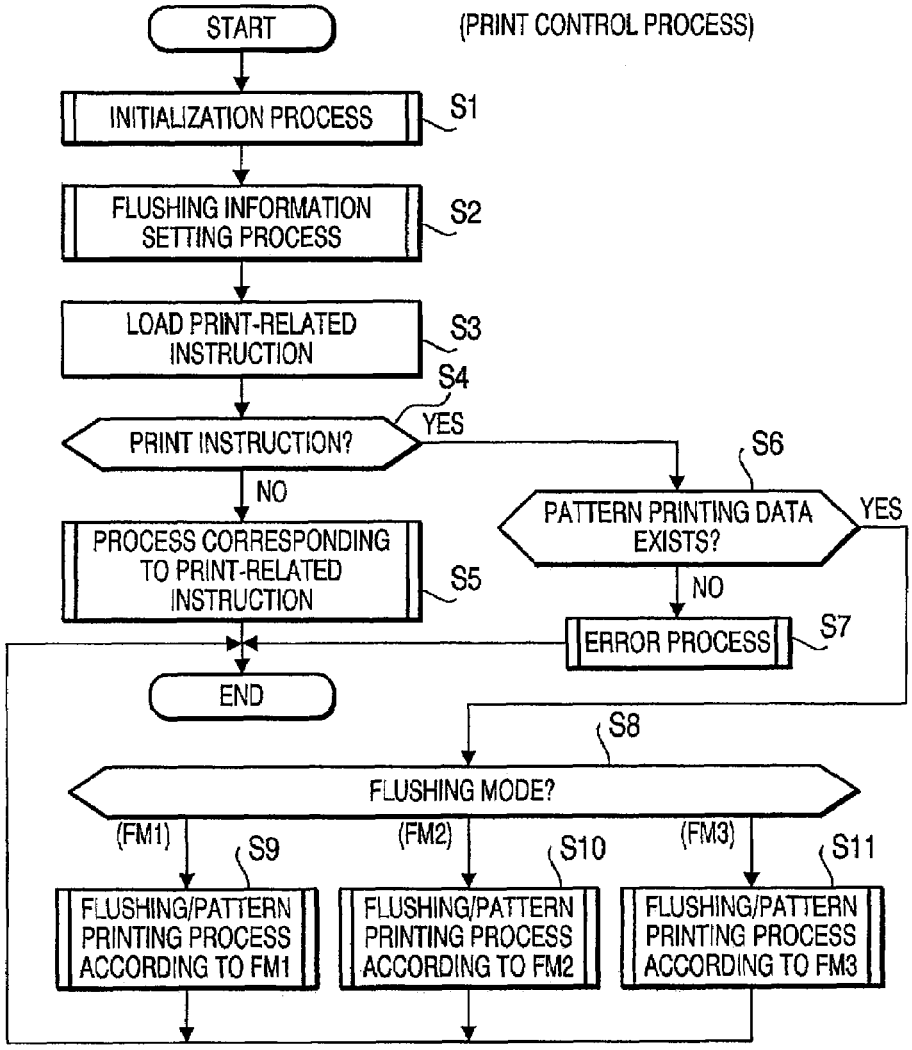
FIG. 17 is a flow chart showing a print control process executed by a control unit of the printer.

FIG. 17 is a flow chart showing the main routine of the print control process executed by the control unit 70. When the printer 1 is turned ON, an initialization process is executed (S1). In the initialization process, the control system of the printer 1 is initialized and the print head 36 of the printing mechanism 20 is positioned at a central position (corresponding to the origin O of the printable area of the fabric holding frame 10 shown in FIG. 6) by letting the frame driving mechanism 12 properly move the fabric holding frame 10.

Subsequently, a flushing information setting process is executed for setting various pieces of flushing information necessary for the flushing printing (S2). In the flushing information setting process, a flushing information setting screen (unshown) is displayed on the display on the front face of the post part 3 and the user of the printer 1 makes selection of a flushing printing pattern (pattern to be printed by the flushing printing) and a flushing mode FM on the flushing information setting screen. The flushing mode FM can be selected from three modes (FM1-FM3). When a flushing mode FM3 (for executing the flushing printing in a frame-shaped area) is selected, the user further sets the width (thickness) "w" of the frame (see FIG. 26) and a gap distance "d" between the flushing printing and the actual pattern printing (see FIG. 26).

After the fabric W to be printed on is attached to the fabric holding frame 10 and the fabric holding frame 10 is attached to the Y carriage 13, a print-related instruction is loaded (S3). If the loaded print-related instruction is not a print instruction (S4: NO), a process corresponding to the print-related instruction is executed (S5). If the loaded print-related instruction is a print instruction (S4: YES), the control unit 70 checks whether or not pattern printing data for the pattern printing exists in the RAM 73 or the pattern data memory 72*a* of the ROM 72 (S6). If no pattern printing data exists in the RAM 73 nor the pattern data memory 72*a* (S6: NO), an error process (e.g. displaying an error message on the display) is executed (S7) and the print control process of FIG. 17 is ended.

On the other hand, if the pattern printing data exists in the RAM 73 or the pattern data memory 72*a* (S6: YES), the control unit 70 checks the flushing mode FM that has currently been set (S8). If the currently set flushing mode is the flushing mode FM1, a flushing/pattern printing process according to the flushing mode FM1 (see FIG. 18) is executed (S9).

At the start of the flushing/pattern printing process according to the flushing mode FM1 (FIG. 18), a flushing printing pattern selection process for selecting a flushing printing pattern for each color is executed (S21). In this step S21, a flushing printing pattern setting screen is displayed on the display and the user selects a desired flushing printing pattern for each color on the flushing printing pattern setting screen.

Subsequently, a rectangular printing area (pattern printing area) is calculated based on printing data (pattern printing data) of a pattern which has been selected or predetermined for the pattern printing, a printing area identical with the calculated pattern printing area is specified as a flushing printing area, and flushing printing data is generated for the flushing printing area according to the selected flushing printing pattern (S22).

In the flushing/pattern printing process according to the flushing mode FM1, the flushing printing is executed first by moving the print head 36 relative to the fabric W in the reverse printing direction RPD (i.e. by actually moving the fabric holding frame 10 in the reverse moving direction rmv) and thereafter the pattern printing is executed by moving the print head 36 relative to the fabric W in the printing direction PD (i.e. by actually moving the fabric holding frame 10 in the moving direction mv).

First, the fabric holding frame 10 is driven so as to move the print head 36 from the central position (corresponding to the origin O shown in FIG. 6) to a position P0 that corresponds to the upper right corner of the pattern printing area (S23). Subsequently, a one-line printing process (see FIG. 19) is executed (S24). At the start of the one-line printing process (FIG. 19), the print head 36 is accelerated (relative to the fabric W) in the reverse printing direction RPD (by actually accelerating the fabric holding frame 10 in the reverse moving direction rmv) in the deceleration section shown in FIG. 7 (between the rightmost position and the print end position in FIG. 7) (S31).

When the print head 36 has reached the print end position shown in FIG. 7 (S32: YES), the fabric holding frame 10 is driven at a constant speed to let the print head 36 move relative to the fabric W at the constant speed. Subsequently, in the constant-speed section, the control unit 70 executes the printing of the flushing printing data for one dot line (S33) and checks whether or not the print head 36 has reached the print start position shown in FIG. 7 (S34). If the print head 36 has not reached the print start position (S34: NO), the process returns to the step S33 to repeat the printing of the flushing printing data for one dot line, by which the flushing printing is executed for a plurality of dot lines.

When the print head 36 has reached the print start position shown in FIG. 7 (S34: YES), the print head 36 is decelerated relative to the fabric W (by actually decelerating the fabric holding frame 10) (S35). When the print head 36 reaches the leftmost position shown in FIG. 7 (S36: YES), the movement of the print head 36 relative to the fabric W (the movement of the fabric holding frame 10) is stopped (S37).

Subsequently, the print head 36 is accelerated (relative to the fabric W) in the printing direction PD (by actually accelerating the fabric holding frame 10 in the moving direction mv) in the acceleration section shown in FIG. 7 (between the leftmost position and the print start position in FIG. 7) (S38). When the print head 36 has reached the print start position shown in FIG. 7 (S39: YES), the fabric holding frame 10 is driven at the constant speed to let the print head 36 move relative to the fabric W at the constant speed. Subsequently, in the constant-speed section, the control unit 70 executes the printing of the pattern printing data for one dot line (S40) and checks whether or not the print head 36 has reached the print end position shown in FIG. 7 (S41). If the print head 36 has not reached the print end position (S41: NO), the process returns to the step S40 to repeat the printing of the pattern printing data for one dot line, by which the pattern printing is executed for a plurality of dot lines.

When the print head 36 has reached the print end position shown in FIG. 7 (S41: YES), the print head 36 is decelerated relative to the fabric W (by actually decelerating the fabric holding frame 10) (S42). When the print head 36 reaches the rightmost position shown in FIG. 7 (S43: YES), the movement of the print head 36 relative to the fabric W (the movement of the fabric holding frame 10) is stopped (S44), the one-line printing process of FIG. 19 is ended, and the process returns to the step S25 of the flushing/pattern printing process according to the flushing mode FM1 (FIG. 18).

In the step S25 of the flushing/pattern printing process according to the flushing mode FM1 (FIG. 18), the control unit 70 checks whether the printing process has been finished or not. If the printing process has not been finished yet (S25: NO), the fabric holding frame 10 is shifted in the sub scanning direction to move the print head 36 to the next printing line (S26) and thereafter the process returns to the step S24 to repeat the one-line printing process (FIG. 19). When the whole printing process is finished (S25: YES), the flushing/pattern printing process according to the flushing mode FM1 (FIG. 18) is ended and the process returns to the main routine (FIG. 17).

In the step S8 of the print control process (FIG. 17), if the currently set flushing mode is the flushing mode FM2, a flushing/pattern printing process according to the flushing mode FM2 (see FIG. 20) is executed (S10).

Figure 18:
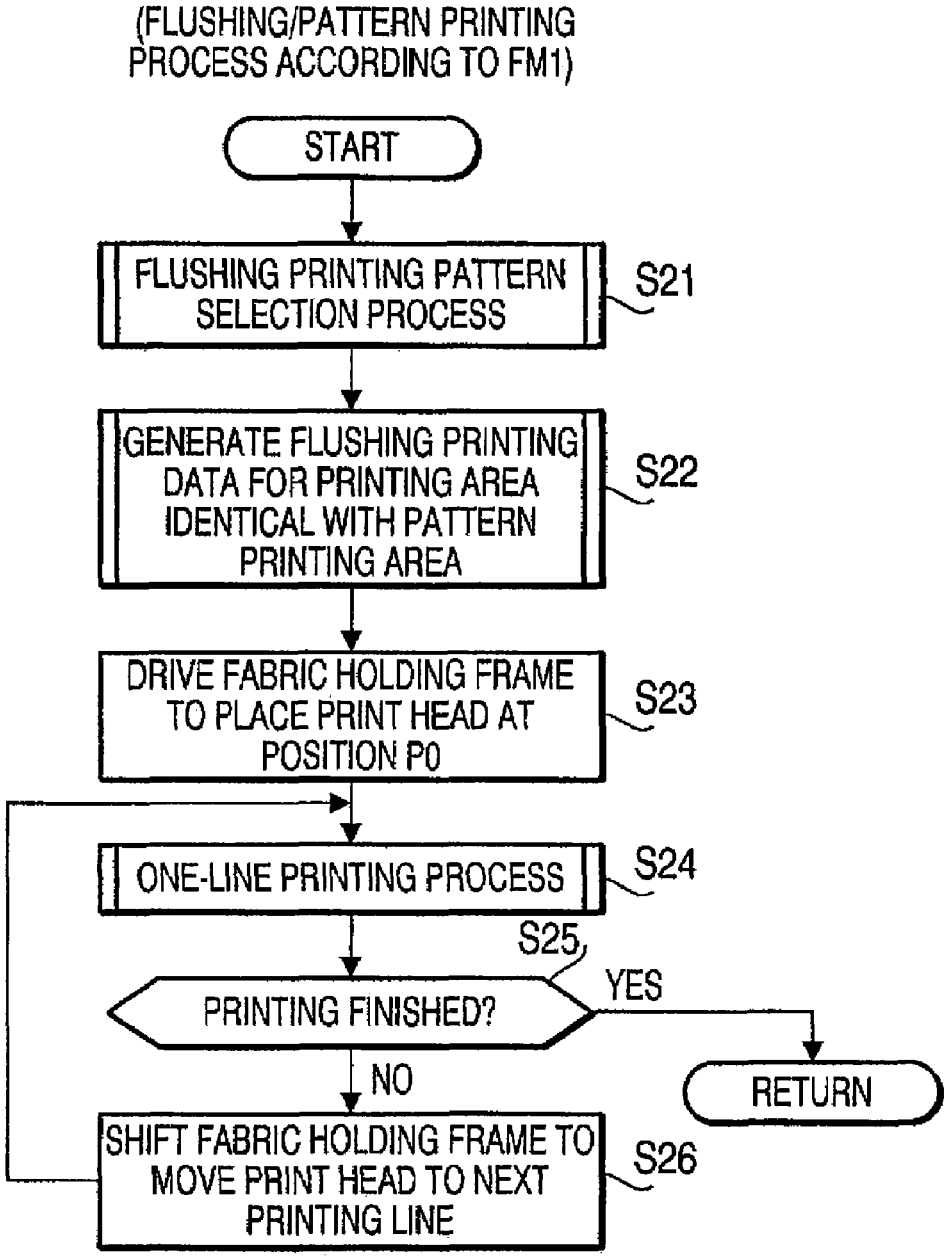
FIG. 18 is a flow chart showing a flushing/pattern printing process according to a flushing mode FM1 which is executed in FIG. 17.
Figure 19:
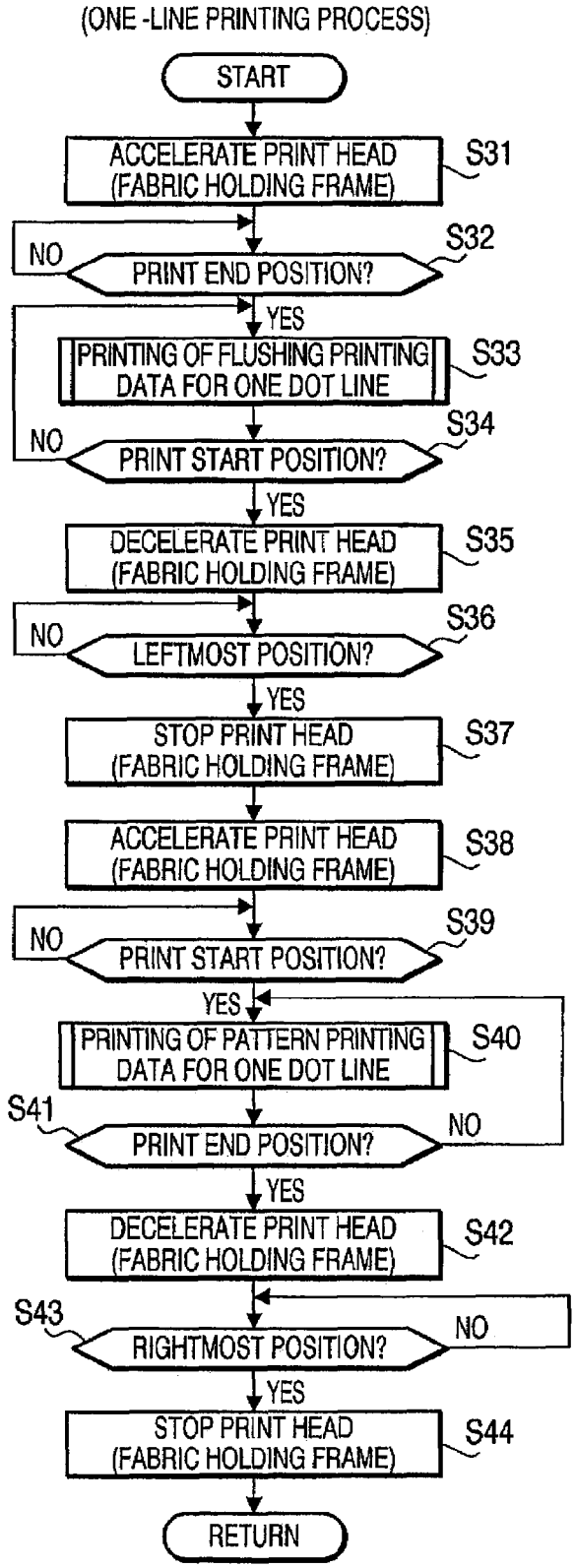
FIG. 19 is a flow chart showing a one-line printing process which is executed in FIG. 18.

At the start of the flushing/pattern printing process according to the flushing mode FM2 (FIG. 20), the flushing printing pattern selection process for selecting a flushing printing pattern is executed similarly to the aforementioned step S21 of FIG. 18 (S51). Subsequently, an acceleration-side flushing printing area FE1 (in the acceleration section) and a deceleration-side flushing printing area FE2 (in the deceleration section) are calculated based on X direction size (size in the X direction) of pattern printing data of a pattern which has been selected or predetermined for the pattern printing, the width of the acceleration section and the width of the deceleration section (see FIG. 25), and thereafter flushing printing data is generated for both the acceleration-side flushing printing area FE1 and the deceleration-side flushing printing area FE2 according to the flushing printing pattern selected by the user (S52).

Subsequently, the fabric holding frame 10 is driven so as to move the print head 36 from the central position (corresponding to the origin O shown in FIG. 6) to the position P0 (S53). Subsequently, a one-line printing process (see FIG. 21) is executed (S54). At the start of the one-line printing process (FIG. 21), the print head 36 is accelerated (relative to the fabric W) in the reverse printing direction RPD (by actually accelerating the fabric holding frame 10 in the reverse moving direction rmv) in the deceleration section shown in FIG. 7 (between the rightmost position and the print end position in FIG. 7) (S61).

In the deceleration section shown in FIG. 7, the control unit 70 executes the printing of the flushing printing data for one dot line (S62) and checks whether or not the print head 36 has reached the print end position shown in FIG. 7 (S63). If the print head 36 has not reached the print end position (S63: NO), the process returns to the step S62 to repeat the printing of the flushing printing data for one dot line, by which the flushing printing is executed for a plurality of dot lines. When the print head 36 has reached the print end position shown in FIG. 7 (S63: YES), the fabric holding frame 10 is driven at a constant speed to let the print head 36 move relative to the fabric W at the constant speed.

Subsequently, in the constant-speed section, the control unit 70 executes the printing of the pattern printing data for one dot line (S64) and checks whether or not the print head 36 has reached the print start position shown in FIG. 7 (S65). If the print head 36 has not reached the print start position (S65: NO), the process returns to the step S64 to repeat the printing of the pattern printing data for one dot line, by which the pattern printing is executed for a plurality of dot lines. When the print head 36 has reached the print start position shown in FIG. 7 (S65: YES), the print head 36 moving in the reverse printing direction RPD relative to the fabric W is decelerated (by actually decelerating the fabric holding frame 10) in the acceleration section shown in FIG. 7 (between the print start position and the leftmost position in FIG. 7) (S66).

In the acceleration section shown in FIG. 7, the control unit 70 executes the printing of the flushing printing data for one dot line (S67) and checks whether or not the print head 36 has reached the leftmost position shown in FIG. 7 (S68). When the print head 36 has not reached the leftmost position (S68: NO), the process returns to the step S67 to repeat the printing of the flushing printing data for one dot line, by which the flushing printing is executed for a plurality of dot lines. When the print head 36 reaches the leftmost position shown in FIG. 7(S68: YES), the movement of the print head 36 relative to the fabric W (the movement of the fabric holding frame 10) is stopped (S69).

Subsequently, the print head 36 is accelerated (relative to the fabric W) in the printing direction PD (by actually accelerating the fabric holding frame 10 in the moving direction mv) in the acceleration section shown in FIG. 7 (between the leftmost position and the print start position in FIG. 7) (S70). In the acceleration section shown in FIG. 7, the control unit 70 executes the printing of the flushing printing data for one dot line (S71) and checks whether or not the print head 36 has reached the print start position shown in FIG. 7 (S72). If the print head 36 has not reached the print start position (S72: NO), the process returns to the step S71 to repeat the printing of the flushing printing data for one dot line, by which the flushing printing is executed for a plurality of dot lines. When the print head 36 has reached the print start position shown in FIG. 7 (S72: YES), the fabric holding frame 10 is driven at the constant speed to let the print head 36 move relative to the fabric W at the constant speed.

Subsequently, in the constant-speed section, the control unit 70 executes the printing of the pattern printing data for one dot line (S73) and checks whether or not the print head 36 has reached the print end position shown in FIG. 7 (S74). If the print head 36 has not reached the print end position (S74: NO), the process returns to the step S73 to repeat the printing of the pattern printing data for one dot line, by which the pattern printing is executed for a plurality of dot lines. When the print head 36 has reached the print end position shown in FIG. 7 (S74: YES), the print head 36 moving in the printing direction PD relative to the fabric W is decelerated (by actually decelerating the fabric holding frame 10) in the deceleration section shown in FIG. 7 (between the print end position and the rightmost position in FIG. 7) (S75).

Figure 20:
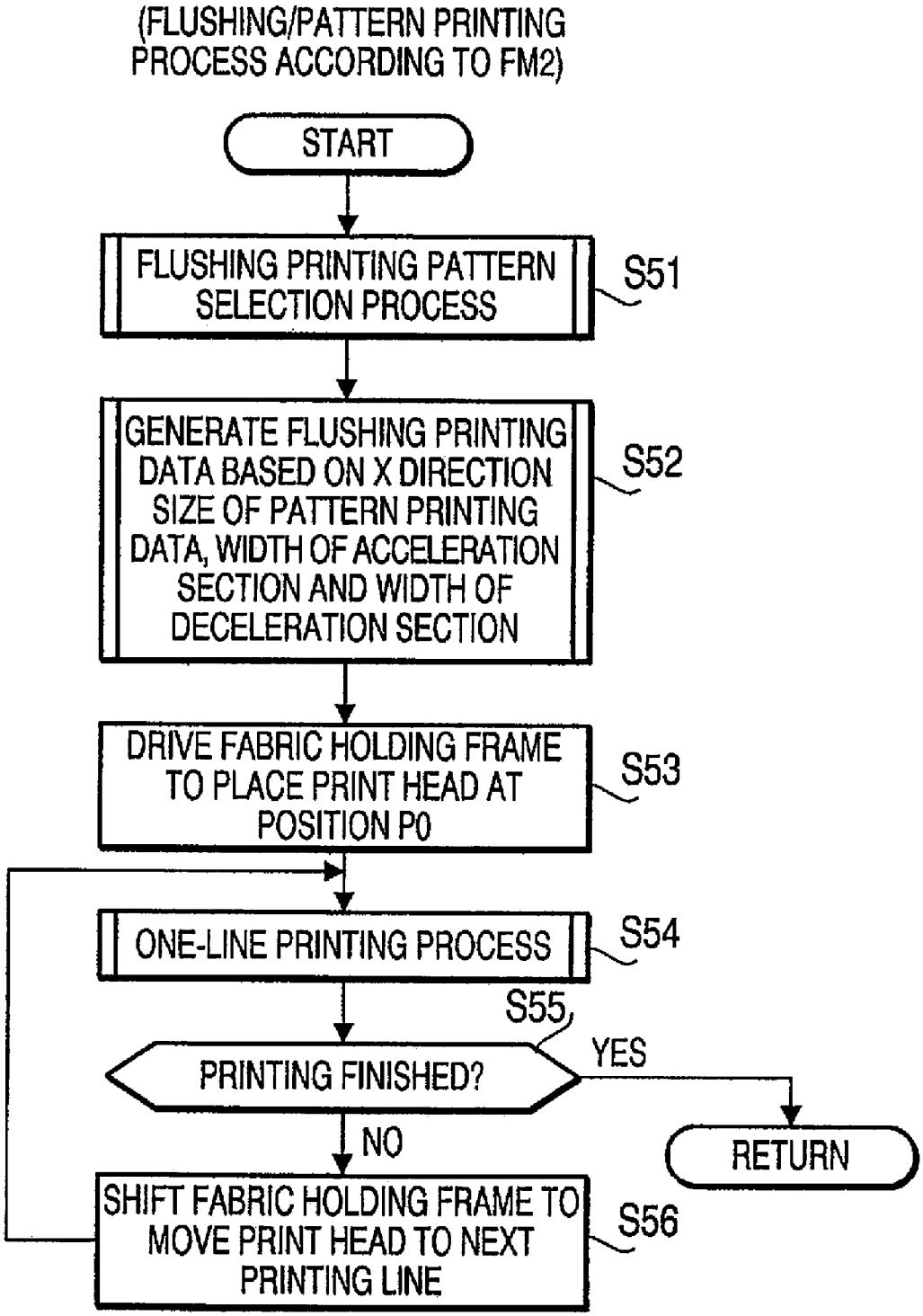
FIG. 20 is a flow chart showing a flushing/pattern printing process according to a flushing mode FM2 which is executed in FIG. 17.
Figure 21:
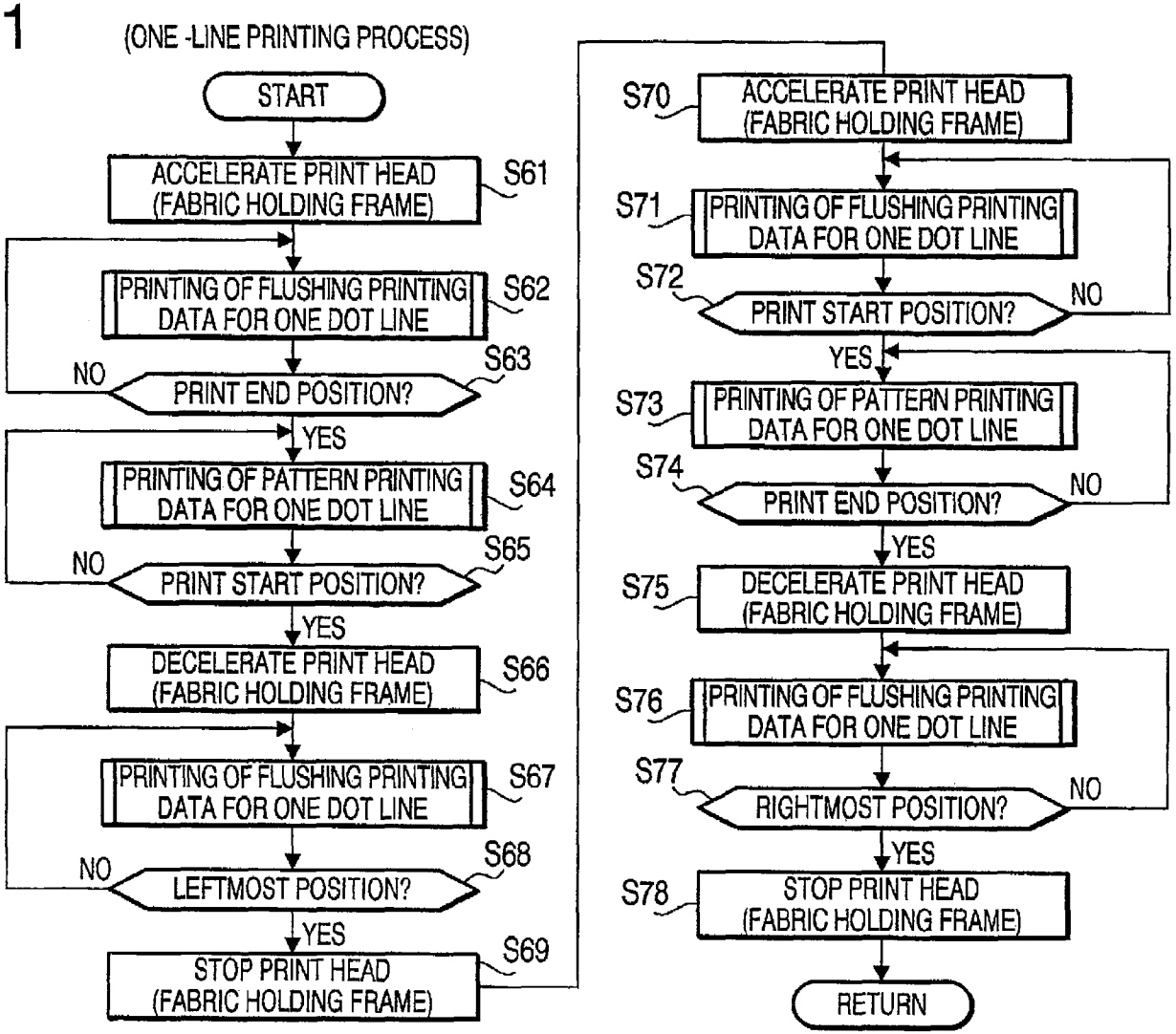
FIG. 21 is a flow chart showing a one-line printing process which is executed in FIG. 20.

In the deceleration section shown in FIG. 7, the control unit 70 executes the printing of the flushing printing data for one dot line (S76) and checks whether or not the print head 36 has reached the rightmost position shown in FIG. 7 (S77). When the print head 36 has not reached the rightmost position (S77: NO), the process returns to the step S76 to repeat the printing of the flushing printing data for one dot line, by which the flushing printing is executed for a plurality of dot lines. When the print head 36 reaches the rightmost position shown in FIG. 7 (S77: YES), the movement of the print head 36 relative to the fabric W (the movement of the fabric holding frame 10) is stopped (S78), the one-line printing process of FIG. 21 is ended, and the process returns to the step S55 of the flushing/pattern printing process according to the flushing mode FM2 (FIG. 20).

In the step S55 of the flushing/pattern printing process according to the flushing mode FM2 (FIG. 20), the control unit 70 checks whether the printing process has been finished or not. If the printing process has not been finished yet (S55: NO), the fabric holding frame 10 is shifted in the sub scanning direction to move the print head 36 to the next printing line (S56) and thereafter the process returns to the step S54 to repeat the one-line printing process (FIG. 21). When the whole printing process is finished (S55: YES), the flushing/ pattern printing process according to the flushing mode FM2 (FIG. 20) is ended and the process returns to the main routine (FIG. 17).

In the step S8 of the print control process (FIG. 17), if the currently set flushing mode is the flushing mode FM3, a flushing/pattern printing process according to the flushing mode FM3 (see FIG. 22) is executed (S11).

At the start of the flushing/pattern printing process according to the flushing mode FM3 (FIG. 22), exterior size of the pattern to be printed is calculated (S81). When the exterior size of the pattern to be printed is smaller than the printable area (S82: YES), a flushing printing area in a frame-like shape is calculated based on the exterior size of the pattern (S83). The calculation of the flushing printing area is executed by use of the width (thickness) "w" of the frame (see FIG. 26) and the gap distance "d" (see FIG. 26) which have been set in the step S2.

Figure 22:
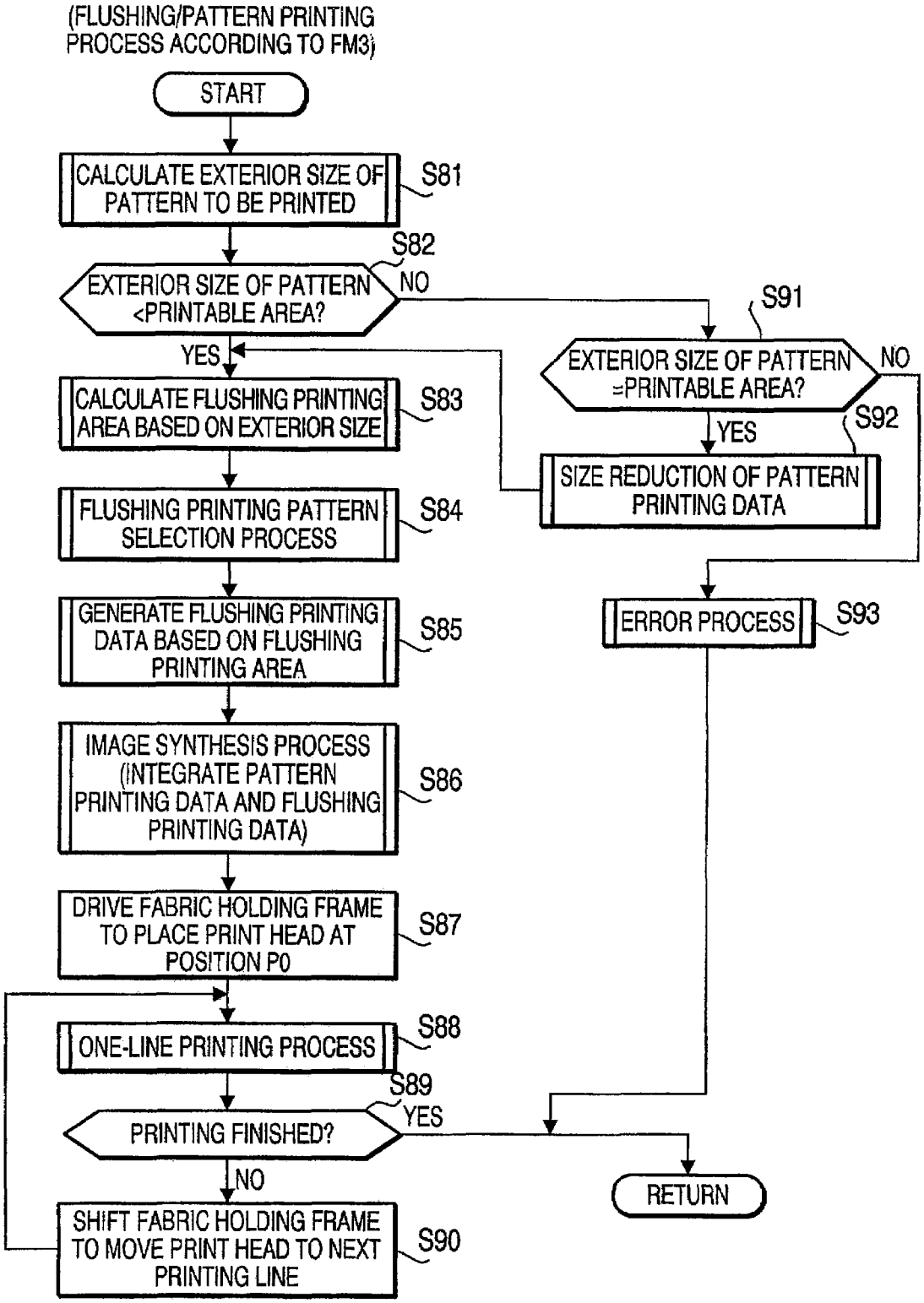
FIG. 22 is a flow chart showing a flushing/pattern printing process according to a flushing mode FM3 which is executed in FIG. 17.

When the exterior size of the pattern to be printed is substantially equal to the printable area (S82: NO, S91: YES), the pattern printing data is reduced to a size approximately 80% of the printable area, for example (S92) and thereafter the flushing printing area is calculated as explained above (S83). When the exterior size of the pattern to be printed is larger than the printable area (S91: NO), the control unit 70 judges that the printing process (pattern printing) is impossible, executes an error process (e.g. displaying a warning message on the display) (S93), and ends the flushing/pattern printing process according to the flushing mode FM3 (FIG. 22).

When the pattern printing is possible, the flushing printing pattern selection process for selecting a flushing printing pattern is executed similarly to the aforementioned step S21 of FIG. 18 (S84). Subsequently, flushing printing data (for executing the flushing printing in the flushing printing area calculated in the step S83) is generated (S85) and an image synthesis process is executed for generating synthesized printing data by integrating the pattern printing data and the flushing printing data (S86). Subsequently, the fabric holding frame 10 is driven so as to place the print head 36 at a position corresponding to the upper right corner of the flushing printing area (S87) and a one-line printing process (see FIG. 23) is executed (S88).

At the start of the one-line printing process (FIG. 23), the print head 36 is accelerated (relative to the fabric W) in the reverse printing direction RPD (by actually accelerating the fabric holding frame 10 in the reverse moving direction rmv) in the deceleration section shown in FIG. 7 (between the rightmost position and the print end position in FIG. 7) (S101). When the print head 36 has reached the print end position shown in FIG. 7 (S102: YES), the fabric holding frame 10 is driven at the constant speed to let the print head 36 move relative to the fabric W at the constant speed.

In the constant-speed section, the control unit 70 executes the printing of the synthesized printing data (generated by the image synthesis process of S86) for one dot line (S103) and checks whether or not the print head 36 has reached the print start position shown in FIG. 7 (S104). If the print head 36 has not reached the print start position (S104: NO), the process returns to the step S103 to repeat the printing of the synthesized printing data for one dot line, by which the synthesized printing (printing of the synthesized printing data) is executed for a plurality of dot lines.

When the print head 36 has reached the print start position shown in FIG. 7 (S104: YES), the print head 36 is decelerated relative to the fabric W (by actually decelerating the fabric holding frame 10) (S105). When the print head 36 reaches the leftmost position shown in FIG. 7 (S106: YES), the movement of the print head 36 relative to the fabric W (the movement of the fabric holding frame 10) is stopped (S107).

Subsequently, the print head 36 is accelerated (relative to the fabric W) in the printing direction PD (by actually accelerating the fabric holding frame 10 in the moving direction mv) in the acceleration section shown in FIG. 7 (between the leftmost position and the print start position in FIG. 7) (S108). When the print head 36 has reached the print start position shown in FIG. 7 (S109: YES), the fabric holding frame 10 is driven at the constant speed to let the print head 36 move relative to the fabric W at the constant speed.

In the constant-speed section, the control unit 70 executes the printing of the synthesized printing data for one dot line (S110) and checks whether or not the print head 36 has reached the print end position shown in FIG. 7 (S111). If the print head 36 has not reached the print end position (S111: NO), the process returns to the step S110 to repeat the printing of the synthesized printing data for one dot line, by which the synthesized printing is executed for a plurality of dot lines.

Figure 23:
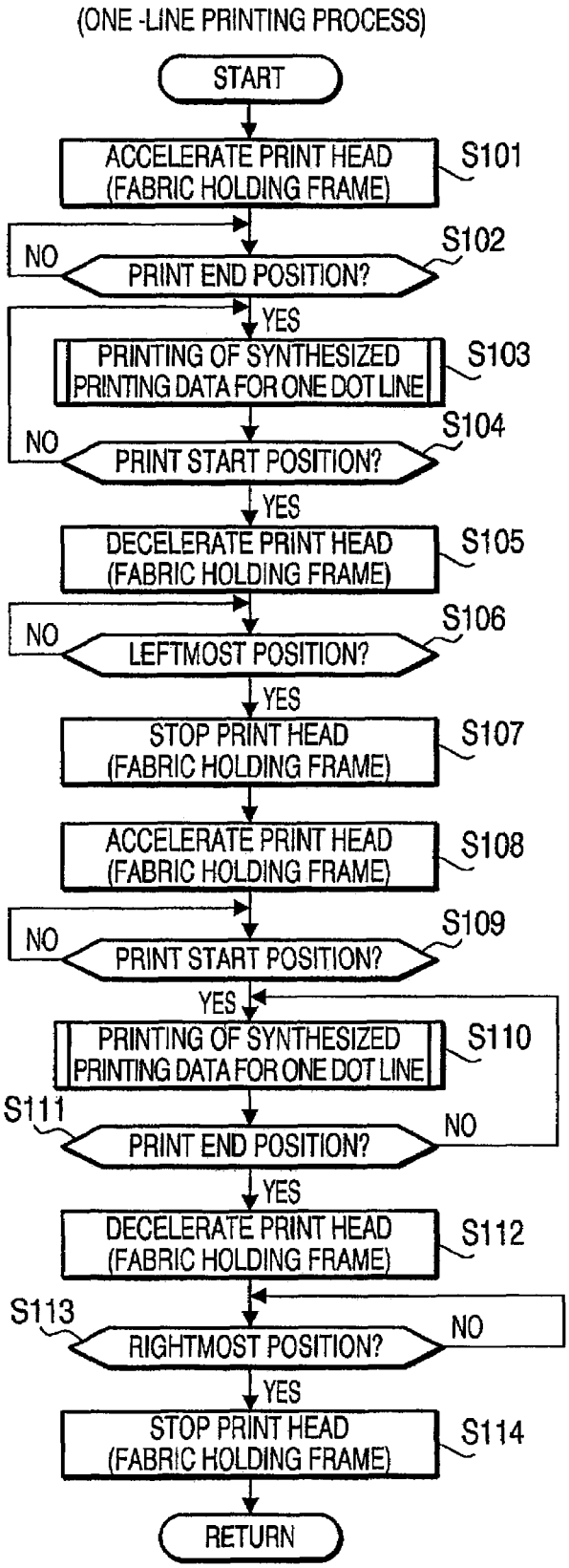
FIG. 23 is a flow chart showing a one-line printing process which is executed in FIG. 22.

When the print head 36 has reached the print end position shown in FIG. 7 (S111: YES), the print head 36 is decelerated relative to the fabric W (by actually decelerating the fabric holding frame 10) (S112). When the print head 36 reaches the rightmost position shown in FIG. 7 (S113: YES), the movement of the print head 36 relative to the fabric W (the movement of the fabric holding frame 10) is stopped (S114), the one-line printing process of FIG. 23 is ended, and the process returns to the step S89 of the flushing/pattern printing process according to the flushing mode FM3 (FIG. 22).

In the step S89 of the flushing/pattern printing process according to the flushing mode FM3 (FIG. 22), the control unit 70 checks whether the printing process has been finished or not. If the printing process has not been finished yet (S89: NO), the fabric holding frame 10 is shifted in the sub scanning direction to move the print head 36 to the next printing line (S90) and thereafter the process returns to the step S88 to repeat the one-line printing process (FIG. 23). When the whole printing process is finished (S89: YES), the flushing/pattern printing process according to the flushing mode FM3 (FIG. 22) is ended and the process returns to the main routine (FIG. 17).

In the following, the operation and effects of the flushing printing and pattern printing explained above (flushing/pattern printing processes according to the flushing modes FM1-FM3) will be described in detail.

When the flushing mode FM1 is selected by the user, the pattern printing area (P1-P4) in a rectangular shape is calculated based on the external form of a pattern "a ship and the sun" as shown in FIG. 24, a printing area identical with the calculated pattern printing area is specified as the flushing printing area, and the flushing printing data is generated for the flushing printing area according to a flushing printing pattern selected by the user (e.g. flushing printing pattern #3).

In the pattern "a ship and the sun", the sun is "yellow", the ship's hull is "black", the cabin is "blue", the smokestack is "red", the smoke billowing from the smokestack is "gray", and the sea is "pale blue". In the to-and-fro movement of the print head 36 relative to the fabric W (caused by the actual to-and-fro movement of fabric holding frame 10 in the main scanning direction), the flushing printing is first executed in a dot density lower than that of the pattern printing when the print head 36 first moves (relative to the fabric W) in a first printing direction (reverse printing direction RPD) in the main scanning direction, and thereafter the pattern printing is executed when the print head 36 moves (relative to the fabric W) in a second printing direction (printing direction PD) along the same printing line in the main scanning direction.

As above, in the flushing/pattern printing process according to the flushing mode FM1, the flushing of the print head 36 (which is generally executed separately from the printing process) is incorporated in the pattern printing, by which the maintenance time necessary for the flushing can be reduced and the printing process can be speeded up while executing the flushing process without fail.

The ink receiving member (which is generally necessary for the flushing) is left out, by which cost reduction and miniaturization of the printer become possible. Since the result of the flushing printing can be concealed later by the pattern printing, the pattern "a ship and the sun" can be printed finely without being affected by the flushing printing. It is also possible to use the result of the flushing printing as a background pattern since part of the result of the flushing printing that is not covered by the pattern printing remains visible, by which decorative effect of the pattern "a ship and the sun" can be enhanced.

Figure 25:
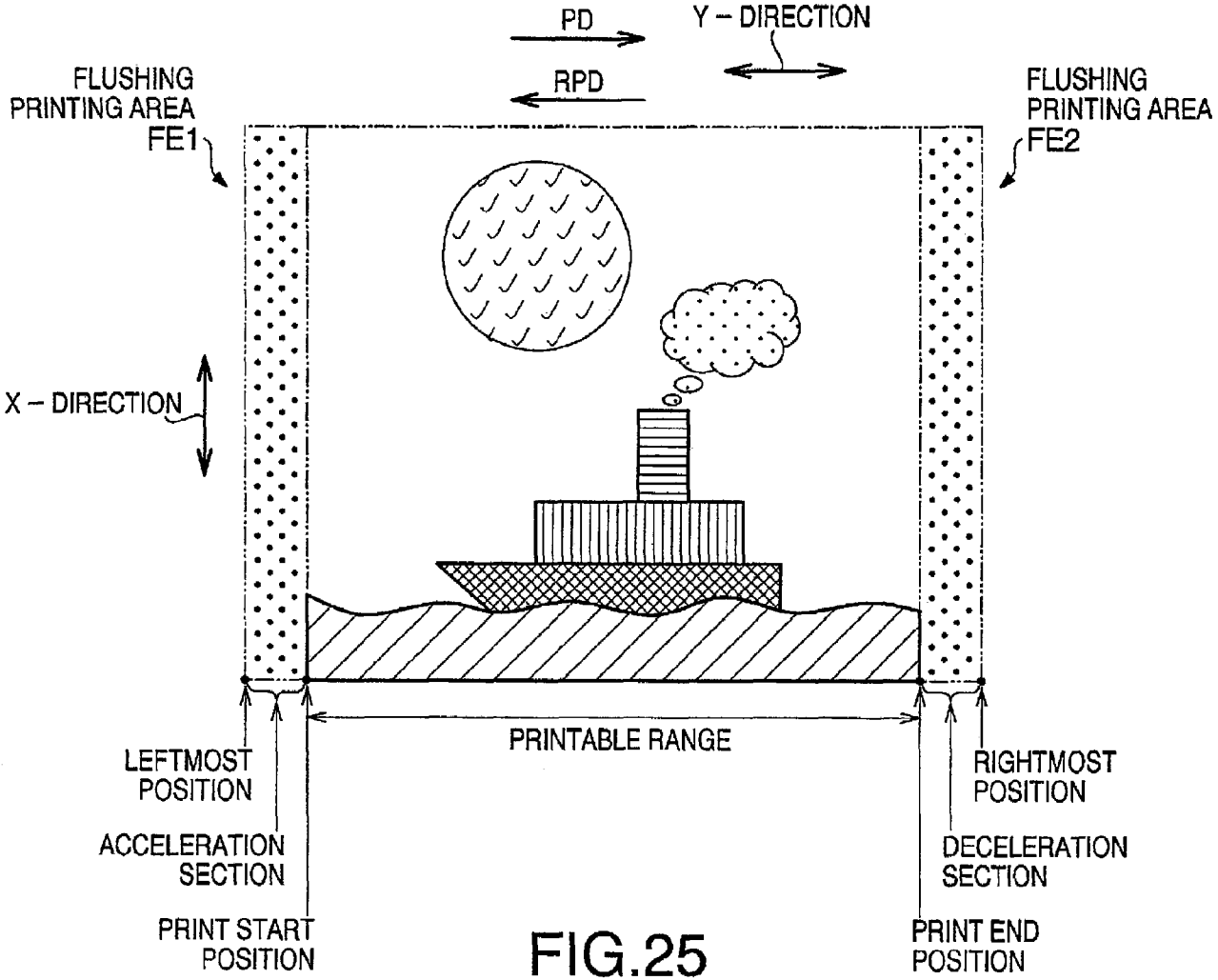
FIG. 25 is a schematic diagram showing an example of the result of the flushing/pattern printing process according to the flushing mode FM2.

When the flushing mode FM2 is selected by the user, an acceleration-side flushing printing area FE1 and a deceleration-side flushing printing area FE2 are calculated based on the X direction size of the pattern "a ship and the sun", the width of the acceleration section and the width of the deceleration section as shown in FIG. 25, and flushing printing data is generated for both the acceleration-side flushing printing area FE1 and the deceleration-side flushing printing area FE2 according to a flushing printing pattern selected by the user (e.g. flushing printing pattern #1).

When the print head 36 first moves (relative to the fabric W) in the first printing direction (reverse printing direction RPD) in the main scanning direction (due to the actual movement of the fabric holding frame 10 in the reverse moving direction rmv), the flushing printing is executed in the deceleration-side flushing printing area FE2, the pattern printing is executed in the printable area (constant-speed section) between the print end position and the print start position shown in FIGS. 7 and 25, and the flushing printing is executed in the acceleration-side flushing printing area FE1. When the print head 36 moves (relative to the fabric W) in the second printing direction (printing direction PD) in the main scanning direction (due to the actual movement of the fabric holding frame 10 in the moving direction mv), the flushing printing is executed in the acceleration-side flushing printing area FE1, the pattern printing is executed in the printable area (constant-speed section) between the print start position and the print end position shown in FIGS. 7 and 25, and the flushing printing is executed in the deceleration-side flushing printing area FE2.

As above, in the flushing/pattern printing process according to the flushing mode FM2, the flushing of the print head 36 (which is generally executed separately from the printing process) is incorporated in the pattern printing, by which the maintenance time necessary for the flushing can be reduced and the printing process can be speeded up while executing the flushing process without fail.

The ink receiving member (which is generally necessary for the flushing) is left out, by which cost reduction and miniaturization of the printer become possible. Since the flushing printing is executed to parts of the fabric W (corresponding to the acceleration section and the deceleration section) separate from the part for the pattern printing, the pattern "a ship and the sun" printed on the fabric W is not affected by the flushing printing. Since the result of the flushing printing is visible in the acceleration-side flushing printing area FE1 and the deceleration-side flushing printing area FE2 which are separate from the printed pattern, the result of the flushing printing can be used as an ornamental frame, by which decorative effect of the pattern "a ship and the sun" can be enhanced.

Figure 26:
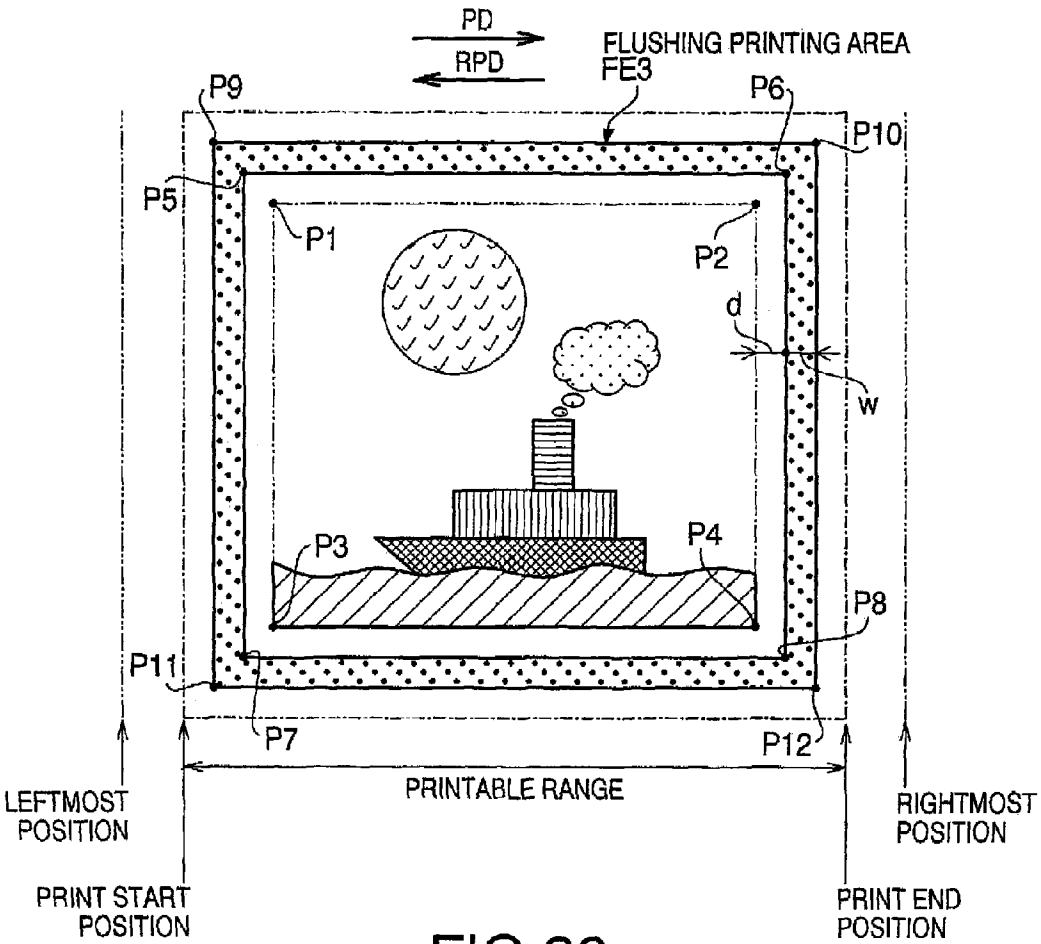
FIG. 26 is a schematic diagram showing an example of the result of the flushing/pattern printing process according to the flushing mode FM3.

When the flushing mode FM3 is selected by the user, the pattern printing area (P1-P4) in a rectangular shape is calculated within the printable area based on the external form of the pattern "a ship and the sun" as shown in FIG. 26, and a flushing printing area FE3 (P5-P12) in a frame-like shape having a prescribed width (thickness) according to the frame width "w" is set outside the pattern printing area while securing the gap distance "d" between the pattern printing area and the frame-shaped flushing printing area FE3. Flushing printing data is generated for the frame-shaped flushing printing area FE3 according to a flushing printing pattern selected by the user (e.g. flushing printing pattern #3) and thereafter the synthesized printing data is generated by integrating the pattern printing data and the flushing printing data.

In the to-and-fro movement of the print head 36 relative to the fabric W (caused by the actual to-and-fro movement of fabric holding frame 10 in the main scanning direction), the synthesized printing (printing of the synthesized printing data) is executed in the printable area.

As above, in the flushing/pattern printing process according to the flushing mode FM3, an ornamental frame in a rectangular frame shape (like a "picture frame") is printed in the printing process, by which the maintenance time necessary for the flushing can be reduced and the printing process can be speeded up while executing the flushing process without fail.

The ink receiving member (which is generally necessary for the flushing) is left out, by which cost reduction and miniaturization of the printer become possible. Since the flushing printing is executed to a frame-shaped part of the fabric W outside (separate from) the part for the pattern printing so as to form an ornamental frame in a rectangular frame shape (like a "picture frame"), the pattern "a ship and the sun" printed on the fabric W is not affected by the flushing printing. The result of the flushing printing is visible as an ornamental frame outside the pattern printing area, by which decorative effect of the pattern "a ship and the sun" can be enhanced.

The following modifications can be made to the above embodiment, for example. When the flushing printing is executed according to the flushing mode FM1, various gradation techniques can be employed for the flushing printing. When the flushing printing is executed according to the flushing mode FM2, the flushing printing areas FE1 and FE2 may also be formed in wavy or zigzag shapes. When the flushing printing is executed according to the flushing mode FM3, the flushing printing area FE3 may also be formed inside the pattern printing area.

When the flushing printing is executed according to the flushing mode FM3, the shape of the flushing printing area FE3 is not restricted to a rectangular frame shape; other frame shapes (circular frame shape, polygonal frame shape, etc.) may also be employed. Further, the shape of the flushing printing area FE3 is not restricted to frame shapes; other shapes (rectangular area, circular area, polygonal area, etc.) may also be employed.

The print medium to be printed on is not restricted to fabric W; the flushing/pattern printing processes according to the above embodiment are also applicable to various print media such as paper, OHP sheets and labels.

While the print head 36 is fixed and the holding member (fabric holding frame 10) is moved during printing in the above embodiment, the printer may also configured to move the print head 36 relative to a fixed holding member during printing.

The printer in accordance with the present disclosure may be configured integrally with an embroidering machine so that printing and embroidering can be executed on fabric W held by a fabric holding frame.

While the printer 1 of the above embodiment employs bidirectional printing, the printer in accordance with the present disclosure may also be configured to execute unidirectional printing.

While a description has been given above of a preferred embodiment in accordance with the present disclosure, the present disclosure is not to be restricted by the particular illustrative embodiment and a variety of modifications, design changes, etc. are possible without departing from the scope and spirit of the present disclosure described in the appended claims.

What is claimed is:

1. A printer comprising:

an inkjet head including a plurality of nozzles for discharging ink;

a holding member which holds a print medium to be printed on;

a moving mechanism which moves at least one of the holding member and the inkjet head so as to move the inkjet head relative to the holding member in a main scanning direction and a sub scanning direction for printing by the inkjet head on the print medium;

a flushing printing data storage unit which stores multiple types of flushing printing data for the flushing printing; and a print control unit, comprising a selection unit which lets a user select a desired type of flushing printing data from the multiple types of flushing printing data stored in the flushing printing data storage unit, and which controls the inkjet head and the moving mechanism so as to execute flushing printing on the print medium for preventing clogging of the nozzles while moving the inkjet head relative to the holding member in a first printing direction in the main scanning direction and to execute pattern printing on the print medium according to pattern printing data while moving the inkjet head relative to the holding member in a second printing direction in the main scanning direction, wherein the flushing printing is executed at a first dot density throughout a pattern printing area, and the pattern printing is executed at a second dot density, and the first dot density is lower than the second dot density.

2. The printer according to claim 1, wherein the print medium is fabric and the holding member is a fabric holding frame which holds the fabric.

3. The printer according to claim 1, wherein:

the inkjet head is placed at a fixed position for the printing; and the moving mechanism moves the holding member relative to the fixed inkjet head in the main scanning direction and the sub scanning direction for the printing.

* * * * *